US007281598B2

(12) United States Patent
Hoi

(10) Patent No.: US 7,281,598 B2
(45) Date of Patent: Oct. 16, 2007

(54) SNOWMOBILE

(75) Inventor: Yoksue Hoi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 140 days.

(21) Appl. No.: 11/110,703

(22) Filed: Apr. 21, 2005

(65) Prior Publication Data

US 2005/0236192 A1 Oct. 27, 2005

(30) Foreign Application Priority Data

Apr. 23, 2004 (JP) ..... 2004-128929

(51) Int. Cl.
*B62D 55/00* (2006.01)

(52) U.S. Cl. ..... 180/186; 180/190; 180/9.25

(58) Field of Classification Search ..... 180/182, 180/186, 190, 291, 297, 400, 9, 9.1, 9.25
See application file for complete search history.

(56) References Cited

U.S. PATENT DOCUMENTS 5,660,245 A * 8/1997 Marier et al. ..... 180/190
5,992,552 A * 11/1999 Eto ..... 180/190
6,454,037 B1 * 9/2002 Atsuumi et al. ..... 180/190
6,464,033 B2 * 10/2002 Izumi et al. ..... 180/291
6,923,283 B2 * 8/2005 Beito ..... 180/190

FOREIGN PATENT DOCUMENTS

JP 2002-266653 A 9/2002

* cited by examiner

*Primary Examiner*—Christopher P. Ellis
*Assistant Examiner*—Brian Swenson
(74) *Attorney, Agent, or Firm*—Birch, Stewart, Kolasch & Birch, LLP

(57) ABSTRACT

To apply special contrivances to the structure and layout of a reserve oil tank disposed on the front side of a dry sump type internal combustion engine mounted on a snowmobile, thereby to achieve effective utilization of space in the snowmobile, and to achieve a further reduction in the size of the snowmobile. A reserve oil tank is laid out on the front side of a dry sump type internal combustion engine mounted on a snowmobile, and the layout of the tank is so made that a tank wall in the longitudinal direction crosses the engine front side. The tank is provided in a tank front wall in the longitudinal direction thereof with an arcuate recessed groove extending vertically in the tank, and a steering shaft vertically passes through the inside of the recessed groove.

17 Claims, 15 Drawing Sheets

SNOWMOBILE

CROSS-REFERENCE TO RELATED APPLICATIONS

The present non-provisional application claims priority under 35 USC 119 to Japanese Patent Application No. 2004-128929 filed on Apr. 23, 2004 the entire contents thereof is hereby incorporated by reference.

BACKGROUND OF THE INVENTION

1. Field of the Invention

The present invention relates to a snowmobile, wherein a structure of a reserve oil tank is provided for a dry sump type internal combustion engine that is mounted on the snowmobile and includes a particular layout structure of the tank.

2. Description of Background Art

A reserve oil tank of an internal combustion engine for a vehicle is generally disposed around the main body of the internal combustion engine. As one example of the reserve oil tank, in the case of an internal combustion engine mounted on a snowmobile, there is known a reserve oil tank for an internal combustion engine which is disposed at a side portion of the mounted internal combustion engine, i.e., at a side position, relative to the traveling direction of the vehicle. See, for example, Japanese Patent Laid-open No. 2002-266653, Page 5, FIG. 8.

The invention disclosed in Japanese Patent Laid-open No. 2002-266653 contains the description of the conditions of a structural portion on the vehicle body front side of a snowmobile. According to the description, a lubricating oil tank, or reserve oil tank, for an internal combustion engine mounted on the snowmobile is laid out at a side portion, relative to the traveling direction of the vehicle, around the internal combustion engine mounted on the snowmobile.

As above-mentioned, the lubricating oil tank for the internal combustion engine is generally laid out around the internal combustion engine, while being not limited to that on a snowmobile. However, more particularly in a vehicle with a limited vehicle body space as in the case of a small-type snowmobile, the layout of the lubricating oil tank, which occupies a comparatively large space, around the engine needs special contrivances in the selection of the layout position, tank shape, etc. due to the spatial factors thereof.

In the case where the layout of the lubricating oil tank for the internal combustion engine around the engine is achieved by disposing the tank at a position on the front or rear side of the crosswise-crankshaft engine, when the steering system is disposed on the front side of the engine as in the snowmobile according to the invention described in Japanese Patent Laid-open No. 2002-266653, the layout of the lubricating oil tank on the front side of the engine is further limited on a spatial basis. In addition, the layout of the oil tank on the rear side of the engine hinders the rider from approaching the engine, so that there again is a limitation from the viewpoint of achieving a compact design.

SUMMARY AND OBJECTS OF THE INVENTION

In the above-mentioned situation, in connection with the layout of a lubricating oil tank, more particularly a dry sump reserve tank, for an internal combustion engine mounted on a small-type snowmobile on the rear side of the engine, it is requested to provide an improved structure of the oil tank by which effective utilization of the limited space in the small-type snowmobile is achieved and which is favorable from the viewpoint of making the vehicle smaller and more compact.

The present invention resides in a snowmobile comprising a dry sump type internal combustion engine mounted on the front side of a vehicle body, a rider's seat provided on the rear side of the internal combustion engine, a crankshaft of the internal combustion engine, and a transmission mechanism through which the rotation of the crankshaft is transmitted to an endless track belt so as to drive the endless track belt to rotate, thereby driving the snowmobile to travel. The internal combustion engine provided on the front side of the rider's seat is mounted with the crankshaft disposed crosswise relative to the traveling direction. The snowmobile includes a reserve oil tank disposed across a central portion of the vehicle body along the internal combustion engine on the front side of the internal combustion engine with a steering shaft provided along the vertical direction at a roughly central portion of the vehicle body on the front side of the internal combustion engine. The reserve oil tank is provided on its front side with a recessed portion through which to pass the steering shaft. The reserve oil tank and the steering shaft are disposed so as to overlap each other at least partly in a vehicle body side view.

In addition, the snowmobile may include a recessed portion that is vertically continuous in the range from an upper end portion to a lower end portion of the reserve oil tank, and is shaped along the inclination of the steering shaft.

Further, the present invention includes a snowmobile having a dry sump type internal combustion engine mounted on the front side of a vehicle body, a rider's seat provided on the rear side of the internal combustion engine, a crankshaft of said internal combustion engine, and a transmission mechanism through which the rotation of the crankshaft is transmitted to an endless track belt so as to drive the endless track belt to rotate, thereby driving the snowmobile to travel. The internal combustion engine provided on the front side of the rider's seat is mounted with the crankshaft disposed crosswise relative to the traveling direction. The snowmobile includes a reserve oil tank disposed across a central portion of the vehicle body along the internal combustion engine on the front side of the internal combustion engine. The oil tank is provided with a cutout portion with an accessory being provided at the cutout portion. The reserve oil tank and the accessory are disposed so as to overlap each other at least partly in a vehicle body side view.

The snowmobile may provide an accessory that is a water pump or a starter motor.

Furthermore, the snowmobile may include a muffler that is provided on the front side of the reserve oil tank, and an exhaust pipe that is connected to the muffler while bypassing the reserve oil tank.

According to the present invention, in the above-mentioned snowmobile, the internal combustion engine is provided on the front side of the rider's seat that is mounted with the crankshaft disposed crosswise relative to the traveling direction. The snowmobile includes a reserve oil tank disposed to cross the center of the vehicle body along the internal combustion engine on the front side of the internal combustion engine with the steering shaft being provided in the vertical direction at roughly a central portion of the vehicle body on the front side of the internal combustion engine. The reserve oil tank is provided on its front side with the recessed portion through which to pass the steering shaft, and the reserve oil tank and the steering shaft are disposed so as to overlap each other at least partly in a vehicle body side view. Therefore, an effective utilize of the space for laying out the steering shaft on the front side of the engine is achieved. Thus, the length in the front-rear direction of the vehicle body can be shortened accordingly.

In addition, since the steering shaft is passed in the vertical direction through the inside of the recessed portion of the tank on the front side of the engine in the condition that the steering shaft overlaps the tank at least partly, the structure is compact. Further, since the steering shaft is entirely or partly covered by a tank front wall in a vehicle side view so as to appear to be shapely as a whole, an enhancement of the appearance is achieved.

According to the present invention, the recessed portion is continuous over the range from an upper end portion to a lower end portion of the reserve tank and is shaped along the inclination of the steering shaft. Therefore, the steering shaft is neatly contained in the recessed portion. Thus, the steering shaft can be laid out compactly, and an effective utilization of the space can be achieved.

According to the present invention, in the above-mentioned snowmobile, the internal combustion engine is provided on the front side of the rider's seat and is mounted with the crankshaft disposed crosswise relative to the traveling direction. The snowmobile includes the reserve oil tank disposed to cross the center of the vehicle body along the internal combustion engine on the front side of the internal combustion engine. The oil tank is provided with the cutout portion, and the accessory is provided in the cutout portion. The reserve oil tank and the accessory are laid out so as to overlap each other at least partly in the vehicle body side view. Therefore, the accessory can be laid out compactly. In addition, since the amount of the projection of the oil tank to the front side of the internal combustion engine is suppressed, the length in the front-rear direction of the vehicle body is shortened accordingly.

According to the present invention, the accessory is a water pump or the starter motor. Therefore, the conventional accessory that is laid out around the engine that requires a comparatively large space can be laid out compactly and with a good appearance while achieving effective utilization of the space around the engine.

According to the present invention, the muffler is provided on the front side of the reserve oil tank, and the exhaust pipe is connected to the muffler while bypassing an upper portion of the reserve oil tank. Therefore, the exhaust pipe layout structure and the muffler layout structure are concentrated into a comparatively narrow space, and the vehicle body front structural portion of the snowmobile can be made to be smaller and more compact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Some embodiments of the present invention will be described, based on FIGS. 1 to 5.

Figure 1:
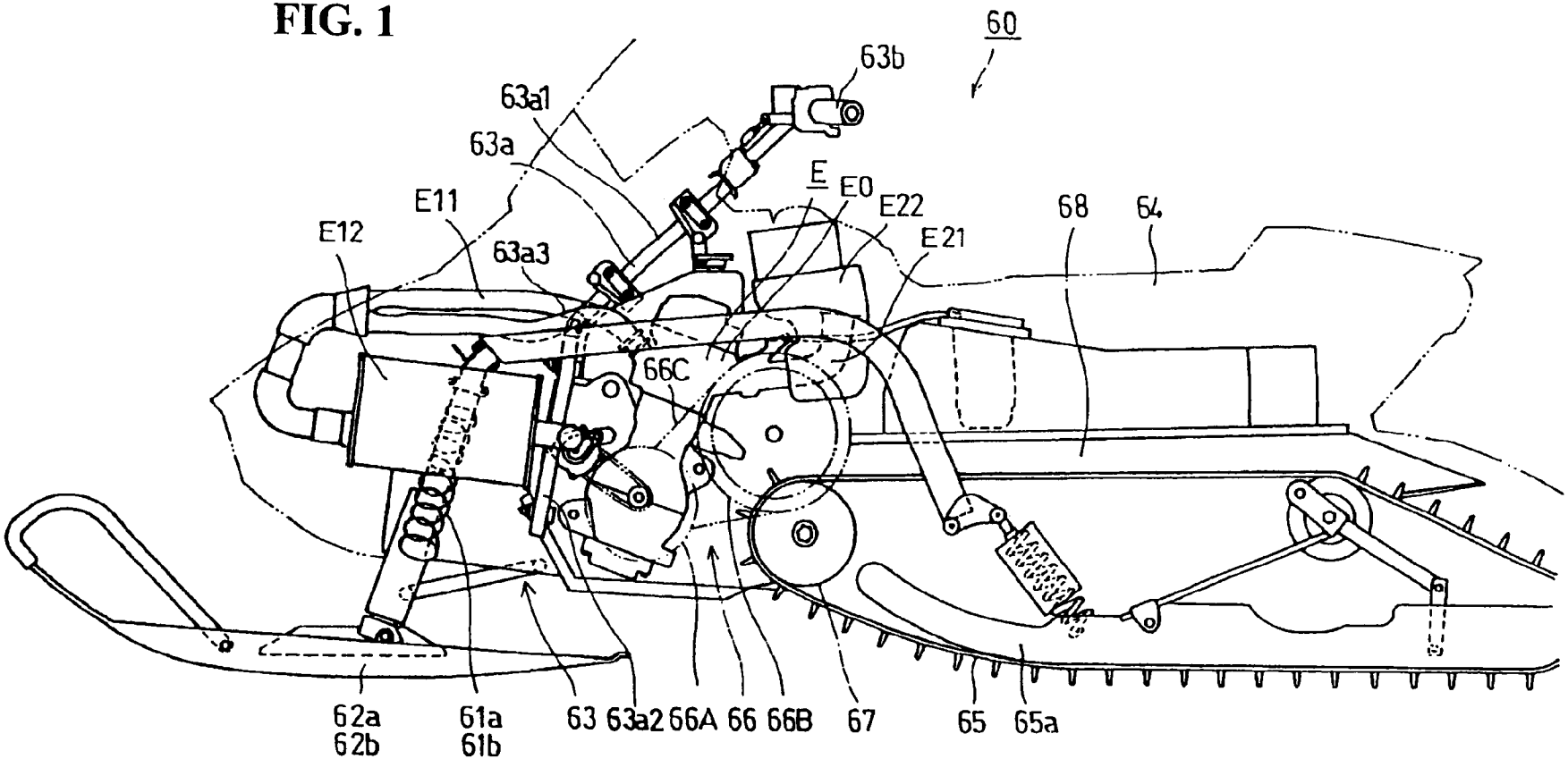
FIG. 1 is a side view of a snowmobile with an internal combustion engine mounted thereon according to the present invention, showing the condition where an outer cover and the like are removed for showing an essential structural part of the snowmobile.
Figure 2:
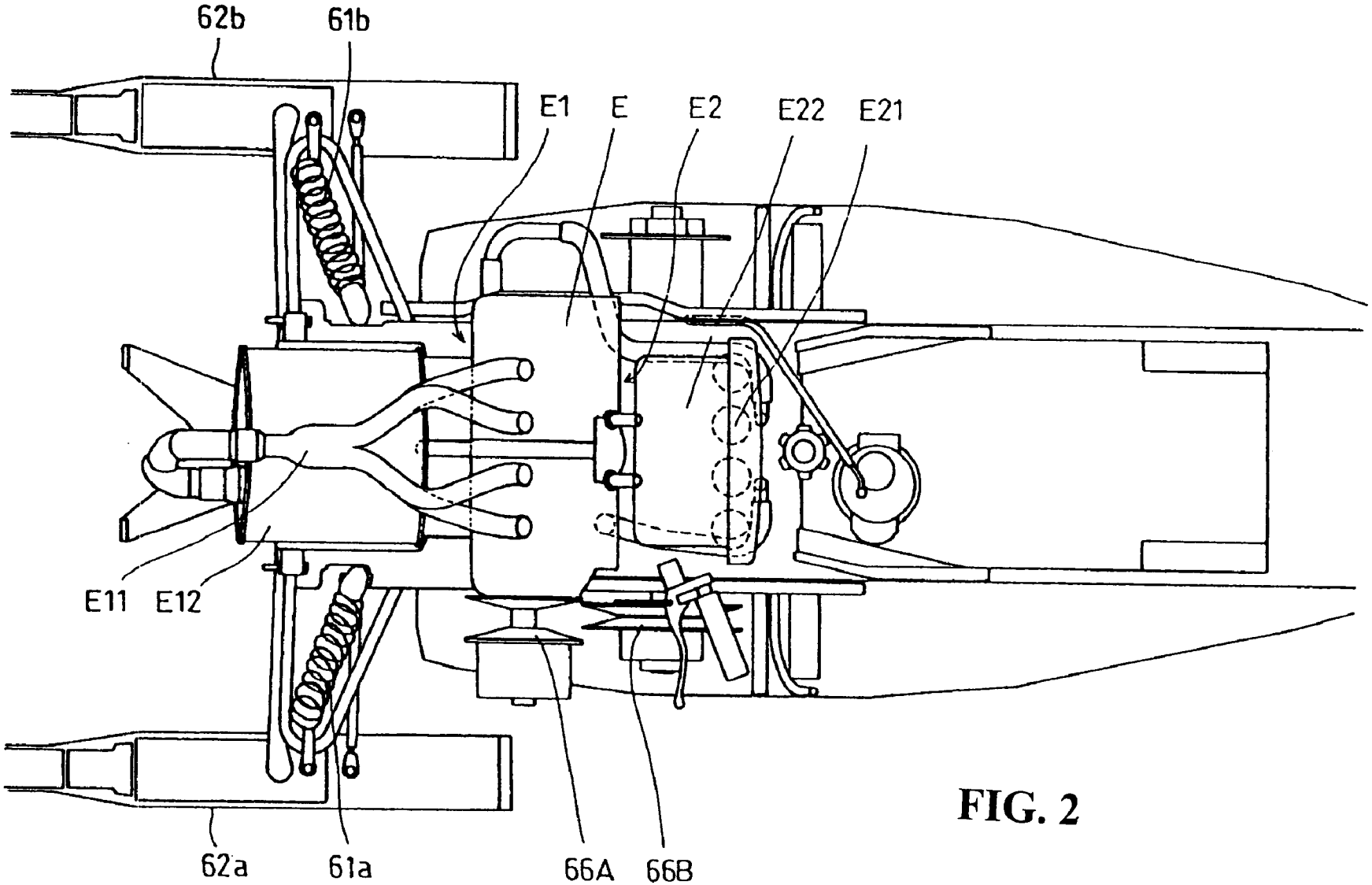
FIG. 2 is a top plan view of the snowmobile with the internal combustion engine mounted thereon according to the present invention, showing the condition where an outer cover, a seat and the like are removed for showing an essential structural part of the snowmobile.

FIG. 1 shows an overall side view of a snowmobile 60 with an internal combustion engine E mounted thereon according to the present invention. FIG. 2 shows an overall top plan view of the snowmobile 60. As understood from FIGS. 1 and 2, the internal combustion engine E is mounted at a position near the front side of the vehicle body of the snowmobile 60. Left and right front suspensions 61*a*, 61*b* are provided at front portions of the vehicle body, and steering skis 62*a*, 62*b* are connected to the front suspension 61*a*, 61*b*.

The steering skis 62*a*, 62*b* are connected to a steering handle 63*b* at roughly a central portion of the vehicle body through members of a steering system 63 such as a steering shaft 63*a*, arm pivots, link rods, etc., and the members of the steering system 63 are disposed so as to pass through the front side of the internal combustion engine E, as will be described later. In addition, a seat 64 of positioning a rider is provided on the vehicle body on the rear side of the steering handle 63*b*.

In addition, a V belt type automatic transmission 66 is provided that includes a drive pulley 66A and a driven pulley 66B forming a drive unit for transmitting the drive force of the internal combustion engine E mounted at a position near the front side of the vehicle body to an endless track belt 65 for propelling the snowmobile 60. A rotational drive force is subjected to a speed change by the automatic transmission 66 with a power transmission system which will be described later that is transmitted to a drive wheel 67, whereby the track belt 65 is driven, and the snowmobile 60 is driven to travel.

A radiator 68 is disposed under the seat 64.

Figure 3:
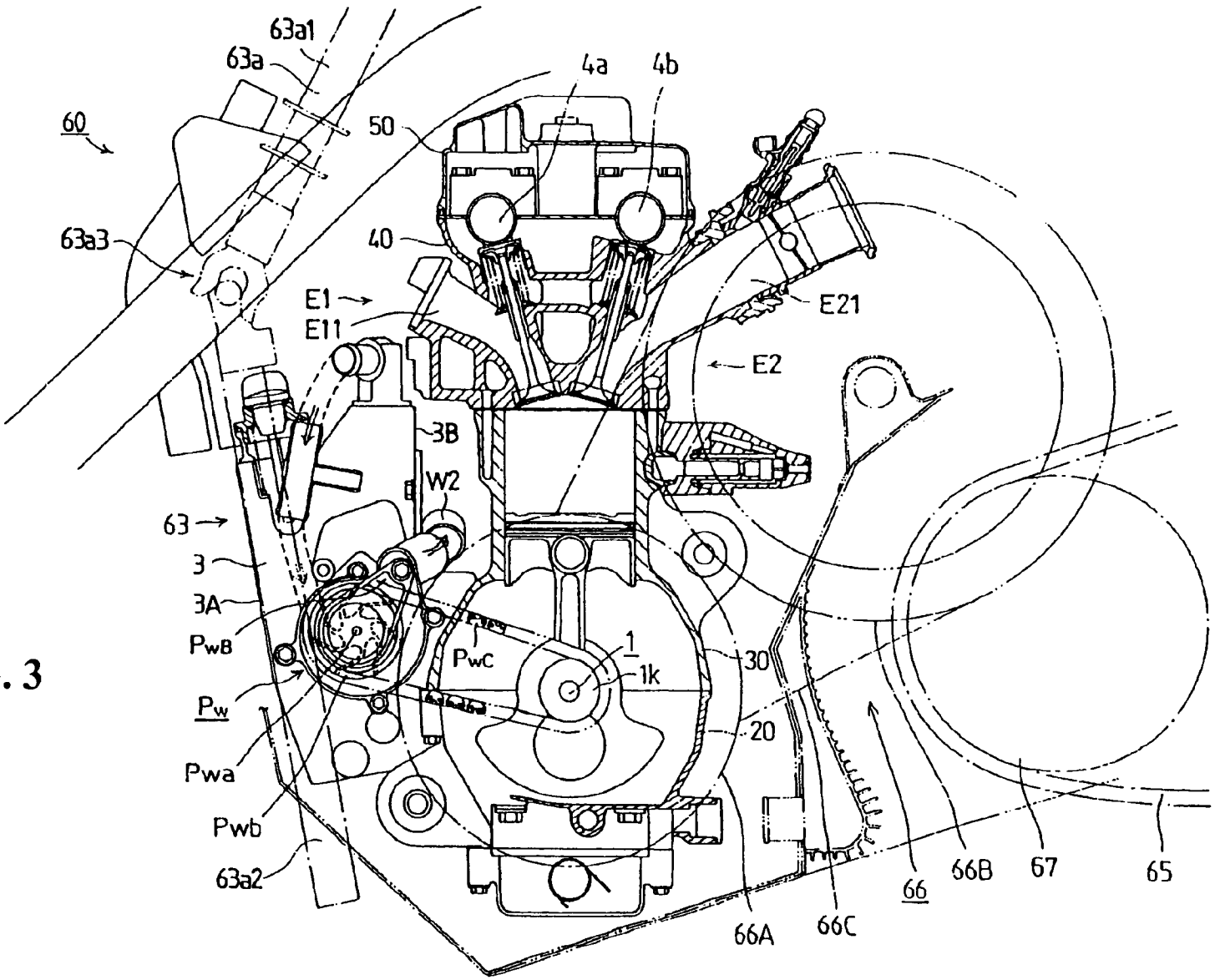
FIG. 3 is an enlarged side view of the vicinity of an internal combustion engine mount portion in the snowmobile according to the present invention.

As is clear by referring to FIG. 1, 2 or 3, an intake pipe E21 and exhaust pipes E11 for the internal combustion engine E are shown wherein the intake pipe E21 extends towards the vehicle body rear side from a rear portion of the engine E and is bent upwardly. An air cleaner E22 is disposed at the upwardly bent portion. In addition, as seen from FIG. 2, the four exhaust pipes E 11 extend towards the vehicle body front side from a front portion of the engine E in a state of being collected in twos and are then collected into one pipe, which is bent in a U shape on the vehicle body front side to be a rearwardly bent portion extending again towards the vehicle body rear side. A muffler E12 is disposed at the rearwardly bent portion.

FIG. 3 is an enlarged view that shows the structure in the vicinity of a mount portion of the internal combustion engine E, together with frames constituting parts of the vehicle body. The above-mentioned V belt type automatic transmission 66 forms a part of the drive unit. Parts of the steering system 63 such as the steering shaft 63*a*, and the like are illustrated in FIG. 3. The internal combustion engine E, mounted on the vehicle body, is mounted in such a condition that its cylinder portion E0 is slightly inclined to the rear side (see FIG. 1). The left side in FIG. 3 illustrates a front portion E1 of the engine E that is directed to the front side of the vehicle body of the snowmobile 60. The front side E1 of the engine E is disposed as the exhaust side. Thus, the above-mentioned exhaust pipes E11 extend from the engine front portion E1. In addition, the manner in which a dry sump reserve oil tank 3 (described in detail later) is disposed on the front side of the engine E is also shown in FIG. 3.

Figure 4:
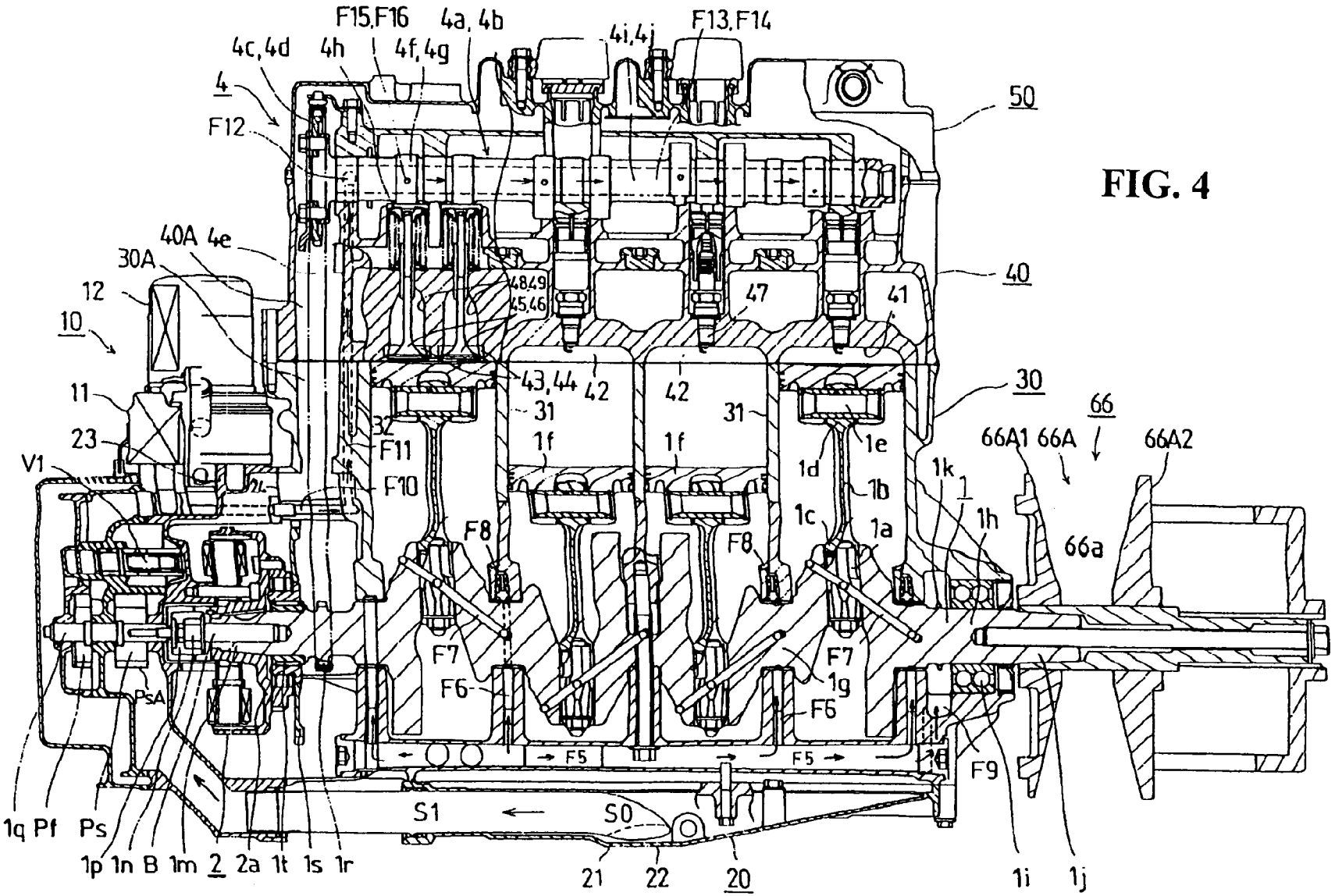
FIG. 4 is a vertical sectional view of an essential structural part of the internal combustion engine according to the present invention.

As shown in a vertical sectional view of an essential part in FIG. 4, the internal combustion engine E includes a main body structure composed of a crankcase 20, a cylinder block 30, a cylinder head 40, and a cylinder head cover 50. A crankshaft 1 is rotatably supported in the crankcase 20 through a bearing, and large end portions 1*c* of connecting rods 1*b* are turnably supported on four crank pins 1*a* of the crankshaft 1. Pistons 1*f* are attached to small end portions 1*d* of the connecting rods 1*b* through piston pins 1*e*, respectively. As is understood from this description, the internal combustion engine E in this embodiment is a series 4-cylinder 4-cycle engine.

The crankshaft 1 is supported by five journal portions 1*g* of the crankcase 20, and is further supported by a ball bearing 1*i* designed in consideration of the above-described V belt type automatic transmission 66 at a position near the right end 1*h* of the crankshaft 1. The drive pulley 66A of the V belt type automatic transmission 66 is mounted to a right-side extending shaft portion 1*j* of the crankshaft 1 which projects to the outside of the bearing support portion for support by the ball bearing 1*i*.

More specifically, the V belt type automatic transmission 66 for transmitting the above-mentioned speed change rotational drive force to the drive wheel 67 for operation of the vehicle is configured so that the rotational drive force of the drive pulley 66A is transmitted through a V belt 66C to the side of the driven pulley 66B with a desired speed reduction (speed change) ratio as shown in FIGS. 1 and 3, and is transmitted from the driven pulley 66B to a sprocket (not shown) coaxial mounted with the drive wheel 67 through a sprocket (not shown) coaxial mounted with the pulley 66B. The transmission of the drive force between the sprockets is performed by a chain or the like (not shown) that is wrapped around both the sprockets.

The rotational drive force that is transmitted to the sprocket that is coaxial with the drive wheel 67 drives the drive wheel 67 to rotate, whereby the traveling drive endless track belt 65 of the snowmobile 60 is driven to rotate along a slide rail 65*a* while being guided by the rail 65*a*, and the snowmobile 60 is propelled.

Figure 5:
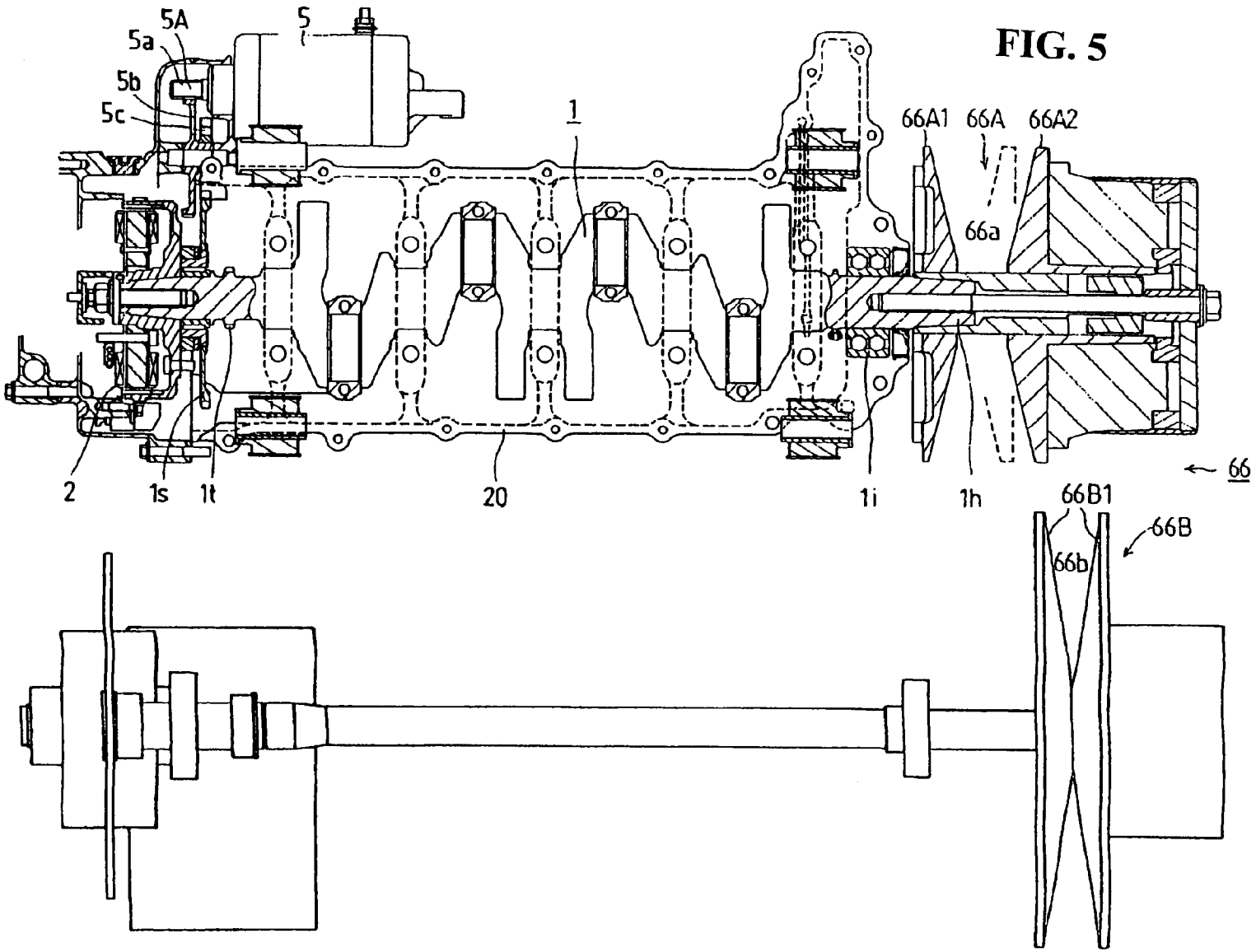
FIG. 5 shows a structural part of a V belt type automatic transmission in a drive mechanism of the snowmobile according to the present invention.

The V belt type automatic transmission 66 will be simply described by referring to FIG. 5. At the time of a low-speed rotation or stoppage of the engine E, the side of the drive pulley 66A is held by the action of a spring (not shown) on the side of the driven pulley 66B so that the width of a V groove 66*a* thereof is enlarged, i.e., the substantial effective diameter of the pulley 66A is reduced, and the side of the driven pulley 66B is held by the action of the spring (not shown) on the side of the driven pulley 66B so that the width of a V groove 66*b* thereof is reduced, i.e., the substantial effective diameter of the pulley 66B is enlarged.

A movable pulley piece portion 66A2 of the drive pulley 66A is equipped with a weight member (not shown in FIG. 5), and the weight member has the action of varying the speed reduction (speed change) ratio in the V belt type automatic transmission 66. The action of a centrifugal force according to the rotation of the engine E (crankshaft 1) moves the weight member in the radial direction of the pulley piece portion 66A2, and, attendantly, the pulley piece portion 66A2 moves in the direction for varying the width of the V groove 66*a*, whereby the speed reduction ratio is varied. This results in an automatic non-stage speed change.

More specifically, at the time of a high-speed rotation of the engine E (crankshaft 1), due to the action of a centrifugal force the weight member (not shown) is moved outwardly in the radial direction of the movable pulley piece portion 66A2 against the above-mentioned spring force (the spring at the driven pulley 66B), and the movable pulley piece portion 66A2 is moved in the direction of reducing the width of the V groove 66*a* in the drive pulley 66A. Therefore, the position of contact of the V belt 66C set in the V groove 66*a* with the V groove 66*a* is shifted radially outwards, whereby the substantial effective diameter of the drive pulley 66A is enlarged.

On the other hand, in the driven pulley 66B, attendant on the shift of the position of contact of the V belt 66C on the side of the drive pulley 66A in the radially outward direction, the pulley piece portion 66B1 is moved against a spring force (not shown) in the direction of contrarily enlarging the width of the V groove 66*b*, whereby the substantial effective diameter of the driven pulley 66B is reduced, and the speed reduction ratio is reduced. With the speed reduction ratio, the endless track belt 65 is driven, and the snowmobile 60 travels at a high speed.

In addition, at the time of a low-speed rotation of the engine E (crankshaft 1), the weight member is located on the radially inside of the movable pulley piece portion 66A2, and the movable pulley piece portion 66A2 is moved in the direction of enlarging the width of the V groove 66*a*, so that the substantial effective diameter of the drive pulley 66A is reduced. On the other hand, the width of the V groove 66*b* in the driven pulley 66B is reduced, the substantial effective diameter of the driven pulley 66B is enlarged, and the speed reduction is enlarged. With the speed reduction ratio, the endless track belt 65 is driven, and the snowmobile 60 travels at a low speed. A V belt type automatic transmission 66 by itself is known.

Referring again to FIG. 4, a sprocket 1*k* includes a small diameter that is provided at a position adjacent to a support portion of the ball bearing 1*i* near the right end 1*h* of the crankshaft 1. A chain Pwc is wrapped around the sprocket 1*k* and a sprocket Pwb is provided on a pump shaft Pwa of a cooling water pump Pw described later (see FIGS. 3 and 12), whereby the cooling water pump Pw is driven in conjunction with the rotation of the crankshaft 1.

On the other hand, a rotor portion 2*a* of a generator 2 is mounted in the vicinity of the left end portion 1*m* of the crankshaft 1, and an oil pump shaft 1*q* is connected to the end portion 1*m* through a joint 1*p* and extends to be provided coaxially with an extended shaft portion In composed of a bolt B rooted in the left end portion 1*m* of the shaft 1. Two oil pumps Pf, Ps are arranged side by side on the oil pump shaft 1*q*.

Of the two pumps arranged side by side relative to the oil pump shaft 1*q*, the oil pump Pf on one side is a feed pump for supplying a lubricating oil, while the oil pump Ps on the other side is a scavenge pump for returning oil collected in a bottom portion 21 of the crankcase 20 to the dry sump reserve oil tank 3. The lubricating oil supplying and feeding actions of the pumps Pf, Ps will be described later and, hence, is not described here.

A sprocket 1*r* with a small diameter is mounted to the crankshaft 1 at a position near the left end portion 1*m* of the crankshaft 1. The sprocket 1*r* is for driving two camshafts 4*a*, 4*b* of a valve operating system 4. A cam chain 4*e* is wrapped around sprockets 4*c*, 4*d* mounted to the camshafts 4*a*, 4*b* and the sprocket 1*r*, whereby the rotation of the crankshaft 1 is transmitted to the two camshafts 4*a*, 4*b* at a one half (½) rotating speed.

In addition, a gear 1*s* with a comparatively large diameter is mounted adjacent to the sprocket 1*r* through a one-way clutch 1*t*. The gear 1*s* is a gear for a starter motor (see FIG. 5), and is connected in a conjunction manner to a gear 5*a* integral with a motor shaft 5A of the starter motor 5 through the meshing between intermediate gears 5*b*, 5*c* (see FIG. 5).

The cylinder block 30 is connected to an upper portion of the crankcase 20, the cylinder block 30 is provided with four cylinder bores 31 penetrating through the block 30 and arranged side by side, and the pistons 1*f* are slid in the four cylinder bores 31 as is known. In addition, the cylinder head 40 is connected to an upper portion of the cylinder block 30.

The cylinder head 40 is provided with four combustion chambers 42 defined by four recessed portions on the lower side thereof and upper portions of the four cylinder bores 31, and the combustion chambers 42 are each provided with intake and exhaust ports 43, 44 for intake and exhaust, intake and exhaust valves 45, 46 for opening and closing the intake and exhaust ports 43, 44, a spark plug 47 and the like.

The cylinder head 40 is provided therein with intake and exhaust passages 48, 49 in communication with the intake and exhaust ports 43, 44 provided in the combustion chambers 42. An upper portion of the cylinder head 40 is provided with the above-mentioned drive system 4 for operating the intake and exhaust valves 45, 46, i.e., cams 4*f*, 4*g*, the (two) camshafts 4*a*, 4*b*, drive mechanisms therefor, tappets 4*h* and the like. In addition, a cylinder head cover 50 is mounted to an upper portion of the cylinder head 40.

Figure 6:
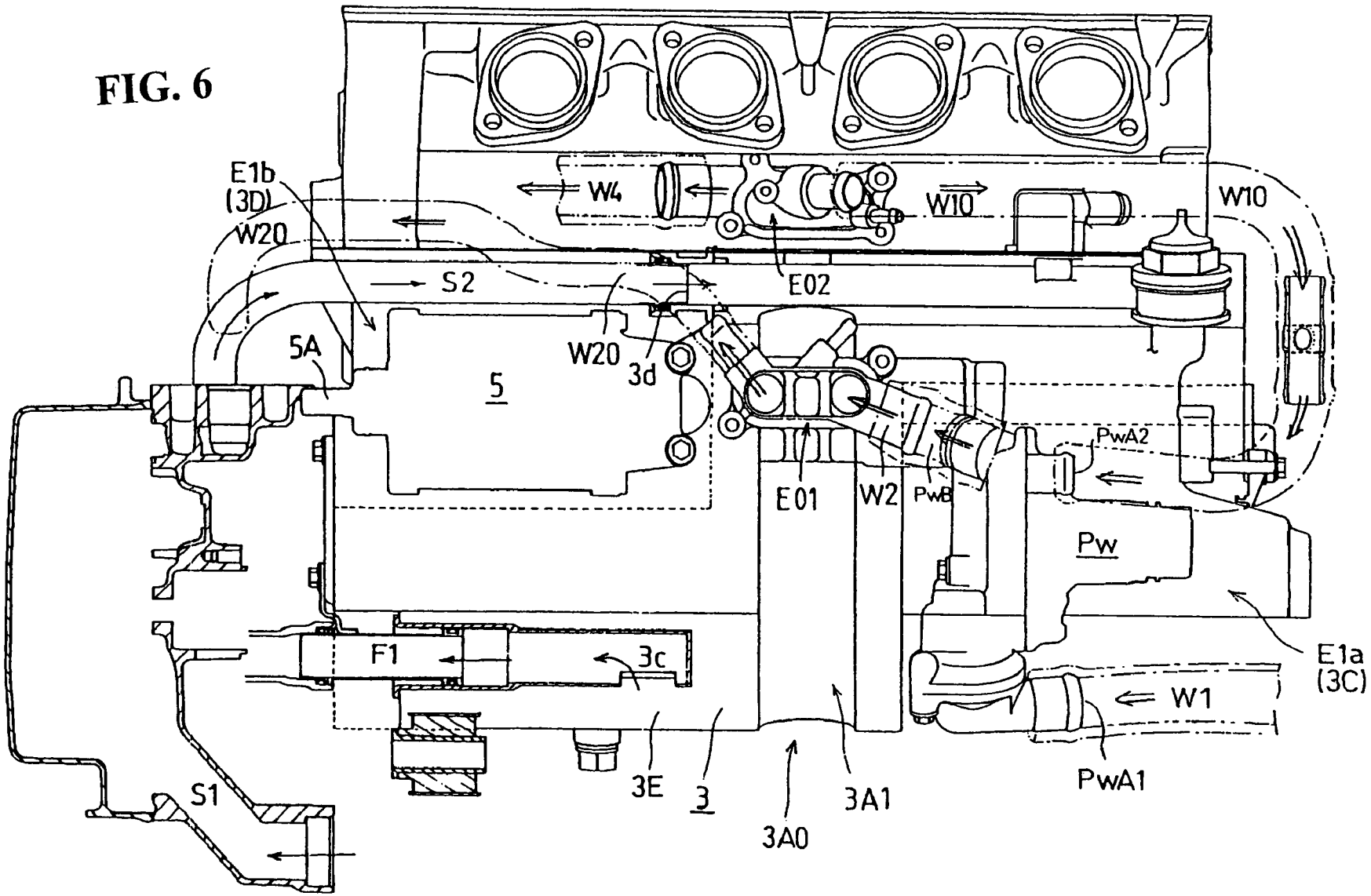
FIG. 6 is a partly sectional view of a structural part on the front side in the vehicle traveling direction of the internal combustion engine according to the present invention.
Figure 7:
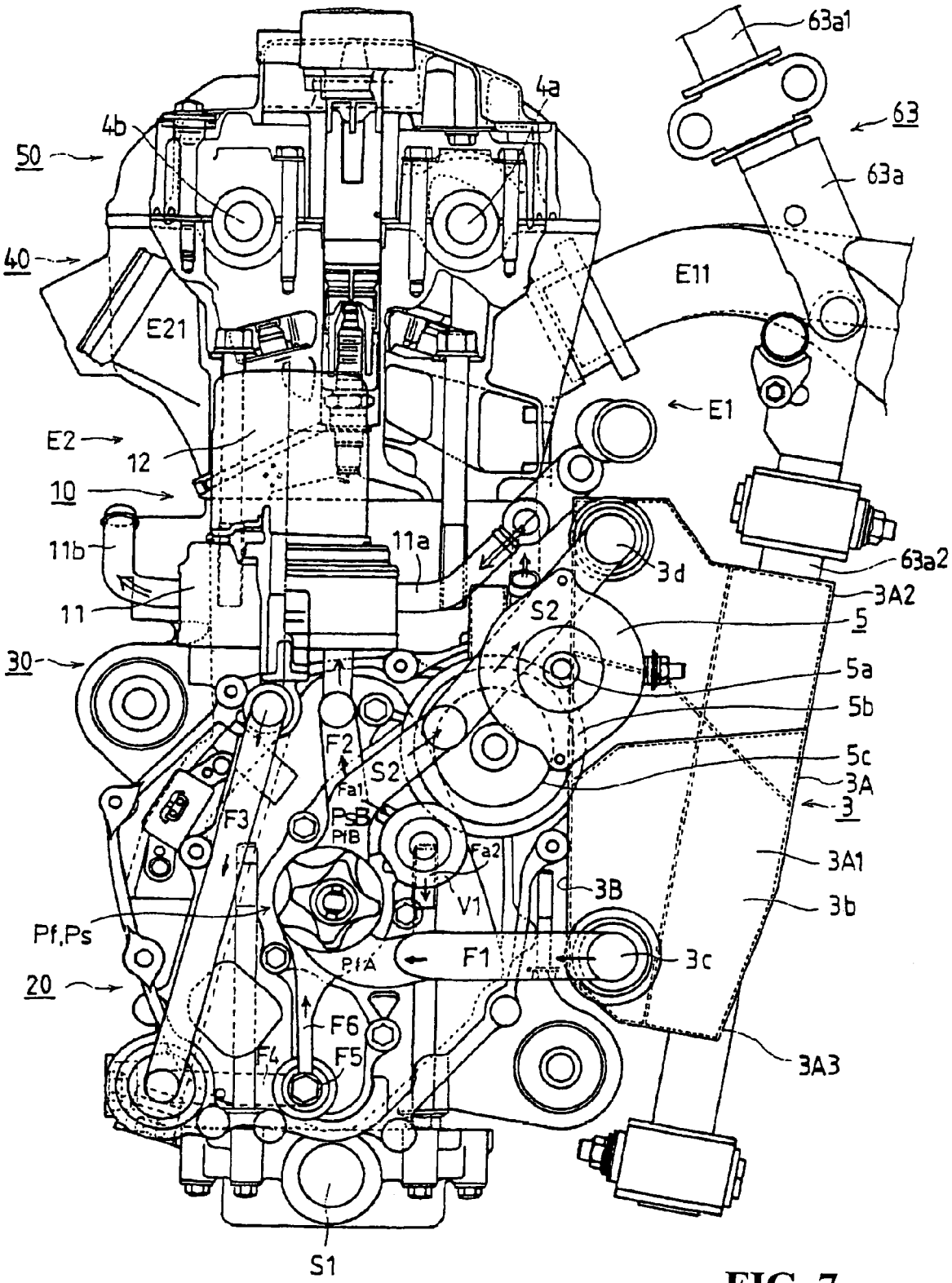
FIG. 7 is a side view showing an essential structural part of the internal combustion engine according to the present invention.

As shown in FIGS. 3 and 7, at a wall portion forming portion between the crankcase 20 and the cylinder block 30 at the front portion E1 of the internal combustion engine E, i.e., at the wall portion forming portion of the front portion E1 of the engine E with the crankshaft disposed orthogonally to the traveling direction of the engine E mounted on the vehicle, the dry sump reserve oil tank 3 is provided having a crosswise length ranging over the roughly whole part of the width of the wall portion forming portion. See FIGS. 6, 9 and 11.

Hereinafter, a somewhat detailed description will be added, centered on the structure of the dry sump reserve oil tank 3 disposed at the front portion E1 of the internal combustion engine 1 and the characteristic features such as the layout of the tank 3 relative to the engine E.

Figure 9:
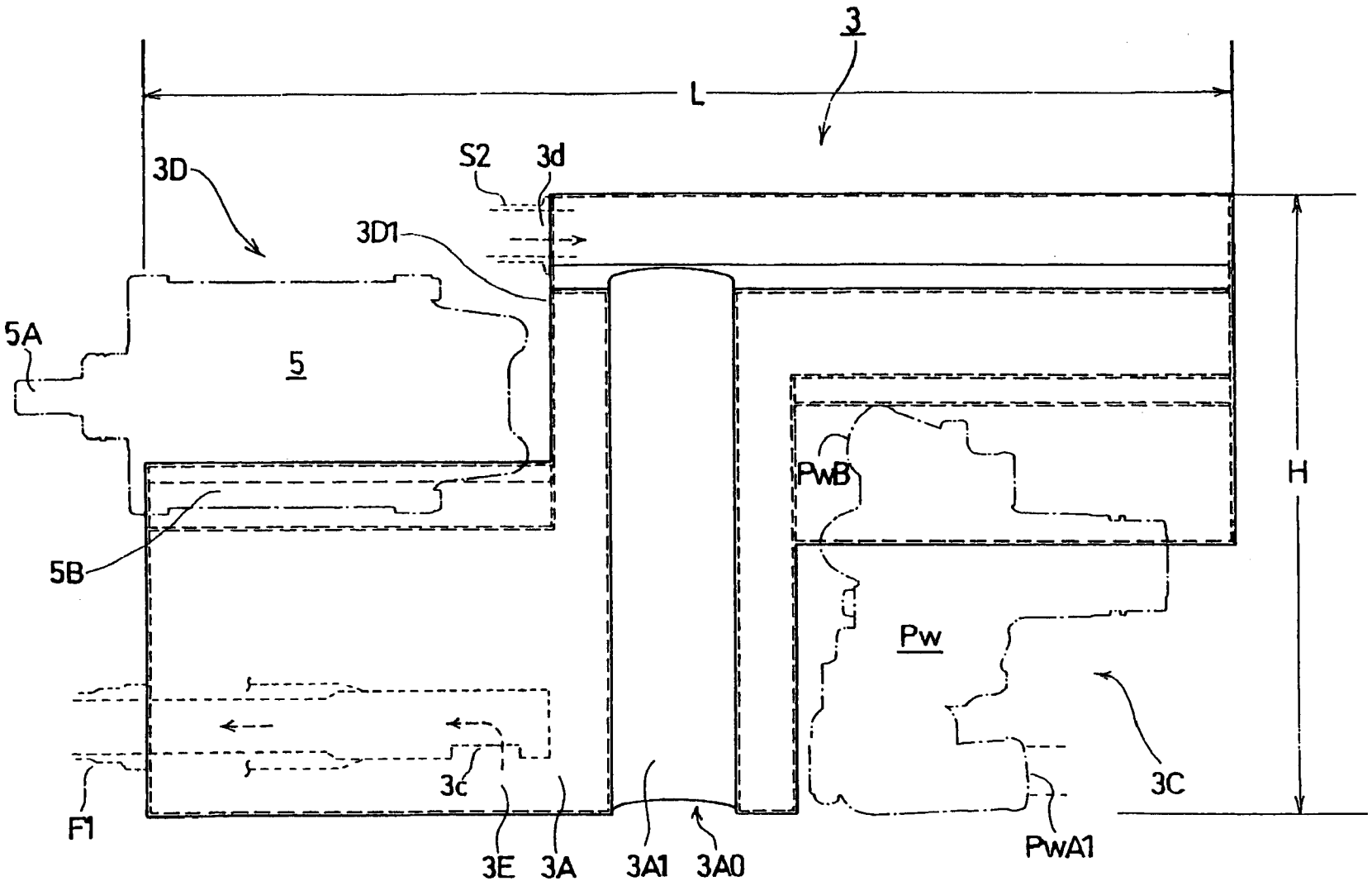
FIG. 9 is a front view of a dry sump reserve oil tank according to the present invention, showing the structure of the tank.
Figure 10:
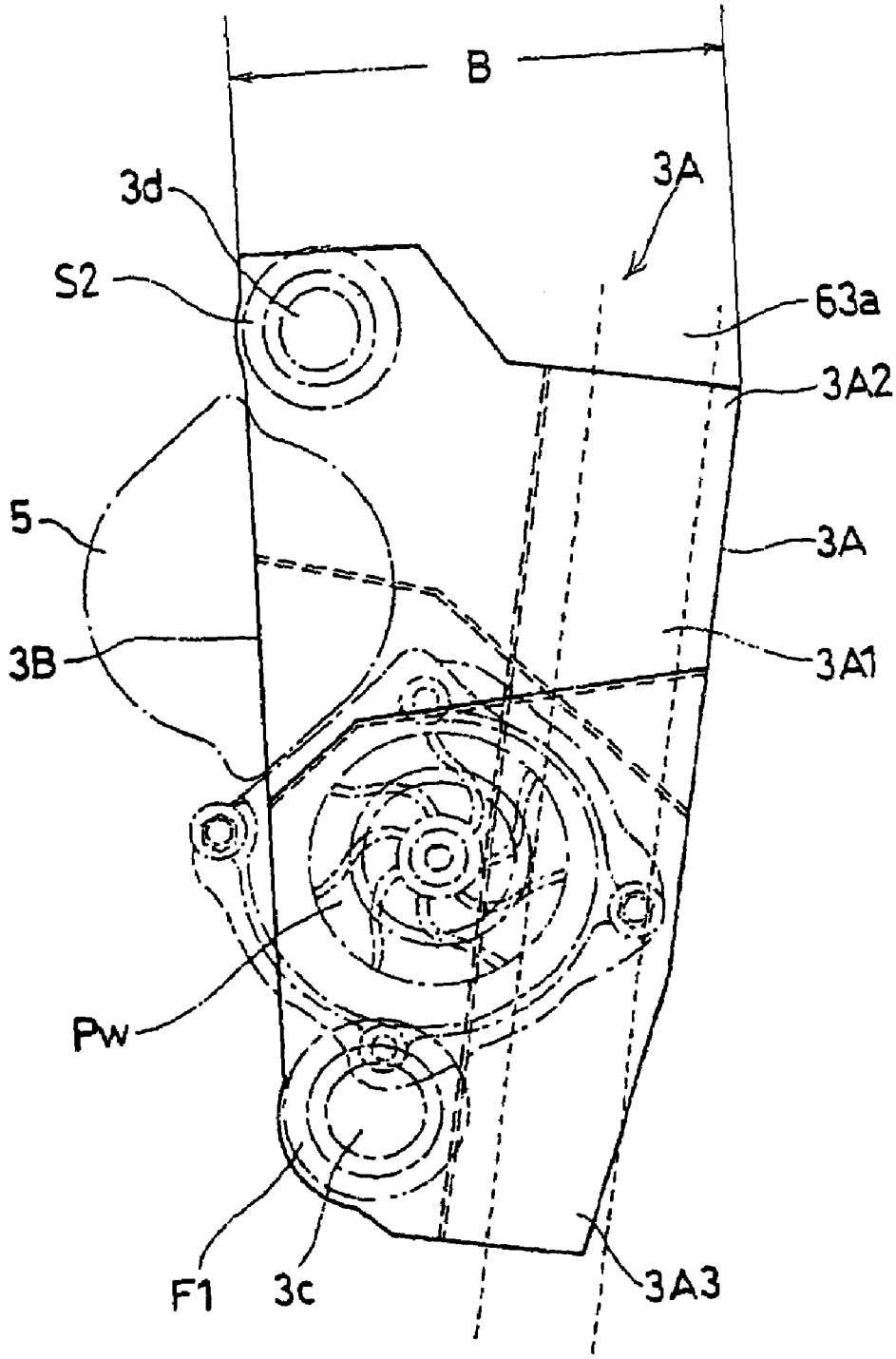
FIG. 10 is a side view of the dry sump reserve oil tank according to the present invention, showing the structure of the tank.
Figure 11:
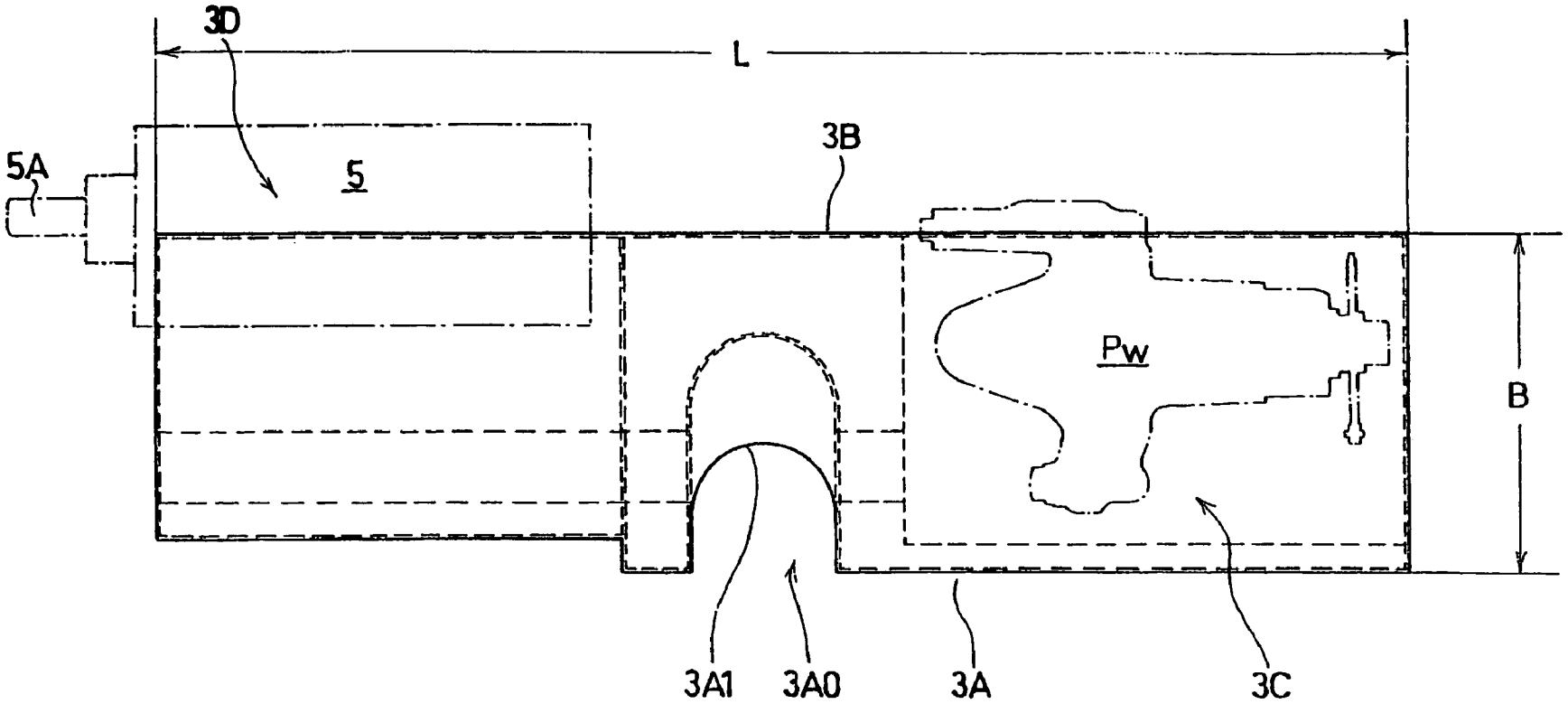
FIG. 11 is a top plan view of the dry sump reserve oil tank according to the present invention, showing the structure of the tank.

The dry sump reserve oil tank 3 is a tank shaped roughly like a rectangular parallelopiped which is elongated crosswise and includes a predetermined width and a predetermined height as shown in FIGS. 9 to 11. In a front view as shown in FIG. 9, in the crosswise direction of the rectangular tank 3, i.e., in the longitudinal direction of the tank 3, a right lower portion and a left upper portion of the tank 3 are rectangularly cut out over a predetermined length and in a predetermined vertical depth. As a whole, the tank 3 has an outside shape similar to a roughly crank form in front view.

As described above, the crosswise length, i.e., the longitudinal length L of the reserve tank 3 is set to a length for crossing the wall portion forming portion of the crankshaft 20 and the cylinder block 30 in the front portion E1 of the engine E in the layout of the tank 3 onto the internal combustion engine front portion E1. See FIG. 6. The height H of the tank 3 is set to a height ranging from a lower portion of the crankcase 20 to a lower portion of the cylinder head 40 at the wall portion forming portion in the layout of the tank 30 onto the internal combustion engine front portion E1. See FIGS. 3, 6, and 7.

In addition, the width B of the reserve oil tank 3 is set to be substantially constant as shown in a top plan view of the tank 3 illustrated in FIG. 11. Thus, the crosswise length of the tank 3 crossing the internal combustion engine front portion E1, i.e., the width, or the length B in the maximum width direction, of the tank 3, as compared with the longitudinal length L and the height H of the tank 3 ranging from the lower portion of the crankcase 20 to the lower portion of the cylinder head 40 is suppressed.

In addition, the width of the reserve oil tank 3 varies according to its position in the height direction. In a side view of the tank 3 as shown in FIG. 10, the tank 3 is wider on the upper side to have a maximum tank width as the tank width B, and the tank 3 is narrower on the lower side. As a whole, the width of the tank 3 is set at a width such that the amount of projection of the tank 3 towards the front side of the engine E in the layout of the tank 3 at the front portion E1 of the engine E is suppressed as much as possible, and such that the cooling water pump Pw (described later) is contained substantially entirely.

The reserve oil tank 3 is provided with a recessed groove 3A1 as a recessed portion penetrating vertically through the tank 3, at a tank central portion 3A0 of one-side tank wall 3A in the crosswise direction of the tank 3, i.e., in the longitudinal direction of the tank 3. As shown in FIG. 11, the recessed groove 3A1 is formed as a recessed groove 3A1 in a recess of a wall surface of the one-side tank wall 3A having roughly an arcuate section, so as to vertically pass, in a trough-like shape and with slight inclination, through the central portion 3A0 of the one-side wall portion 3A.

The trough-like recessed groove 3A1 is for passage of the steering shaft 63*a* (see FIGS. 3 and 7) passing on the front side of the one-side tank wall 3A forming substantially the tank front wall in the layout of the tank 3 to the engine front portion E1 (described later). For this purpose, the recessed groove 3A1 is formed with an arcuate section so as to be capable of passing and containing, with an allowance and without hindering the turning of the steering shaft 63*a* which is circular in section. A second extended portion 63*a*2 of the steering shaft 63*a* will be described later.

Of the recessed groove 3A1 for the passage of the steering shaft 63*a*, the depth of the arcuate section is set to such a depth that the steering shaft 63*a*, more accurately the second extended portion 63*a*2 (described later) of the steering shaft 63*a* is substantially wholly contained in a vehicle side view. In other words, in the vehicle side view, the second extended portion 63*a*2 of the steering shaft 63*a* is entirely covered by the one-side wall 3A in the longitudinal direction of the tank 3, namely, by the front wall of the tank 3. However, the structure may naturally be a structure in which the depth of the arcuate section of the recessed groove is smaller and the steering shaft 63*a* is partly covered.

The respective sizes of the cutouts 3C, 3D provided at the tank right lower side and tank left upper side of the one-side tank wall 3A of the reserve oil tank 3 are formed so that a sufficiently large space is secured for containing the cooling water pump Pw and the starter motor 5 (described later) that are disposed around the engine E in the layout of the tank 3 to the engine front portion E1.

The cutout 3C on the right lower side is for forming a space serving to contain the cooling water pump Pw, and has a crosswise length and a length in a height direction sufficient for the purpose. On the other hand, the cutout 3D on the left upper side is for forming a space that serves for containing the starter motor 5, and has a crosswise length and a length in a height direction sufficient for the purpose.

At an upper portion of the cutout (3D) forming side wall portion 3D1 near the tank center portion of the cutout 3D on the left upper side of the reserve oil tank 3, an upper opening 3*d* opened to the left side in FIG. 9 is formed, which is an opening 3*d* serving for receiving a return oil to the reserve oil tank 3 described later. In addition, at a lower portion 3E near the central portion of the tank 3 located roughly vertically opposite to the opening 3*d* with respect to the tank 3, a lower opening 3*c* opened to the lower side is formed, which is an opening 3*c* serving as a supply port of the lubricating oil from the tank 3 as described later.

The structure of the dry sump reserve tank 3 as a single body is substantially as described above. While the oil tank 3 is laid out at the front portion E1 of the internal combustion engine E as described above, the condition of the layout of the oil tank 3 onto the engine E is as shown in FIGS. 3, 6 and 7.

The layout of the dry sump reserve oil tank 3 at the front portion E1 of the engine E is such that the one-side tank wall 3A in the longitudinal direction of the oil tank is on the front side, i.e., on the side opposite to the engine E, as described above, and that the other-side wall 3B being roughly vertical is opposed to the above-mentioned predetermined wall forming portion, i.e., the wall portion formed between the crankcase 20 and the cylinder block 30, with a predetermined gap therebetween and by an appropriate means which is not clearly shown in the FIG. 7.

In a side perspective view of the layout of the reserve oil tank 3 at the engine front portion E1, as shown in FIGS. 3, 7 and 10, the oil tank 3 has a width larger on the upper side and smaller on the lower side, and the other-side tank wall 3B on the side of the engine E is roughly vertical. Therefore, the one-side tank wall 3A on the front side is disposed so that an upper front portion 3A2 thereof projects slightly to the front side, i.e., projects so as to part away from the front portion E1 of the engine E, and a lower front portion 3A3 thereof is retracted toward the side of the engine E.

In addition, in a front perspective view of the front portion E1 of the engine E from the front side of the engine E, in the layout of the oil tank 3 at the engine front portion E1, a space portion E1*a* defined by the above-mentioned rectangular cutout 3C is formed at a right lower portion of the tank 3, and a space portion E1*b* defined by the above-mentioned rectangular cutout 3D of the tank 3 is formed at a left upper portion of the tank 3.

The above-mentioned upper opening 3*d* for receiving the return oil which is formed with the opening portion directed to the left side in FIG. 9 on the upper side of the side wall portion 3D 1 near the tank center of the space portion E1*b* defined by the cutout 3D at the left upper portion of the tank 3 is connected to a collected oil return oil passage S2, and the upper opening 3*d* for receiving the return oil is communicated with the scavenge pump Ps not shown in FIG. 6 through the oil passage S2.

At the lower portion in the vicinity of a central portion in the width direction of the tank 3, i.e., at the return oil receiving upper opening 3*d* in the width direction of the tank 3, the above-mentioned lower opening 3*c* for supplying the lubricating oil which has the opening portion directed to the lower side of the tank lower portion 3E which is substantially vertically opposed to the upper opening 3*d* is connected to a lubricating oil suction oil passage F1, and the lower opening 3*c* is communicated with the feed pump Pf not shown in FIG. 6 through the oil passage F1.

At the space portion E1*a* defined by the cutout 3C on the right lower side in the front perspective view of the tank 3, the cooling water pump Pw is disposed as above-mentioned. The pump Pw is mounted to the engine front portion E1, and the cooling water pump Pw in this mount condition is disposed with its cooling water suction port PwA1 on the lower side and its cooling water discharge port PwB on the upper side so that the vicinity of the upper discharge port is covered by a tank structural portion in the front perspective view (see FIG. 9) and that the lowermost side in the vicinity of the lower suction port PwB is located at a position substantially the same as a lowermost portion of the tank 3. See FIGS. 6 and 9.

For the positioning of the cooling water pump Pw, as shown in FIG. 11, the reserve oil tank 3 has a width B for sufficiently covering the amount of projection to the front side of the engine E of the cooling water pump Pw disposed at the position indicated FIG. 9 by dot-dash lines in the top plan view in the condition of layout of the tank 3 at the engine front portion E1.

In addition, as mentioned above, the starter motor 5 is disposed in the space portion E1*b* defined by the cutout 3D on the left upper side in the front perspective view of the reserve oil tank 3. The starter motor 5 is mounted to the front portion E1 of the engine E, and, in this condition, the starter motor 5 is contained and held in the space portion E1*b* with the projecting direction of the motor shaft 5A thereof directed to the left side FIG. 9, i.e., outwards in the width direction of the engine E. See FIG. 6.

In the front perspective view, a portion 5B on the lower side of the starter motor 5 is covered by a structural portion of the reserve oil tank 3 (see FIG. 9). In the top plan view of the tank 3, the starter motor 5 is located so that about one half of the width thereof is covered over the entire length thereof (see FIG. 10).

At the tank wall 3A on one side of the dry sump reserve oil tank 3 in the front perspective view of the tank 3, i.e., the recessed groove 3A1 is arcuate in section passing on the upper and lower sides of the tank 3 which is formed in a roughly central portion 3A0 in the left-right direction of the front wall of the tank 3 with the steering shaft 63*a* jointed to the steering handle 63*b* of the snowmobile 60. More specifically, the second extending portion 63*a*2 (described later) of the shaft 63*a* is disposed to pass vertically and without hindering the turning thereof, and the vertical passage of the steering shaft 63*a* through the recessed groove 3A of the second extended portion 63*a*2 is disposed in an inclined condition with its upper portion slightly on the front side relative to the engine E and with its lower portion retracted toward the engine, as mentioned above. See FIG. 7.

The layout for vertical passage, without hindering the turning, of the second extended portion 63*a*2 of the steering shaft 63*a* through the recessed groove 3A1 in the central portion 3A0 of the reserve oil tank 3 is in the above-mentioned inclined structure relative to the engine E where the upper portion of the extended portion 63*a*2 is located on the front side and the lower portion of the extended portion 63*a*2 is retracted toward the engine E.

However, in the structure for the inclined layout of the second extending portion 63*a*2 of the steering shaft 63*a*, the mount condition of the internal combustion engine E on the snowmobile 60 is in the rear inclined layout as shown in FIGS. 1 and 3, so that the substantial equipment condition of the steering shaft 63*a* in the snowmobile 60 is such that the upper portion of the second extending portion 63*a*2 of the shaft 63*a* is slightly inclined toward the rear side of the vehicle, and the steering shaft 63*a* is provided on the snowmobile 60.

In short, as seen from FIG. 6, the reserve oil tank 3 laid out onto the above-mentioned internal combustion engine E having the above-mentioned structure provides a structure in a front view such that the cooling water pump Pw and the starter motor 5 are disposed at the front portion E1 of the engine E on the left and right positions with respect to a steering post which is the recessed groove 3A1 vertically passing through the tank 3 at the tank central portion 3A0 for the steering system 63.

In addition, the steering shaft 63*a* is composed of a straight pipe formed of an ordinary steel material or the like, and is directed along the center in the width direction of the snowmobile 60 rearwardly from the front side of the engine E while passing through the upper side of the engine E. The upper end of the upper extending portion 63*a*1 of the shaft 63*a* reaches a substantially central portion in the vehicle body front-rear direction of the snowmobile 60. The steering handle 63*b* is mounted to the upper end of the extending portion 63*a*1 with the extending portion 63*a*1 extending straight to the front side of the engine E while being directed from the steering handle 63*b* skewly downwards at a comparatively moderate inclination angle and passing through the upper side of the internal combustion engine E.

The second extending portion 63*a*2 turns downwardly with a directionality of its extension direction slightly toward the front side through a joint portion 63*a*3 at a vertically corresponding portion on the front side of the mounted internal combustion engine E that is connected to the extending portion 63*a*1 of the steering shaft 63*a*. The downward second extending portion 63*a*2 is passed through the inside of the steering post composed of the recessed groove 3A1 that is formed in the tank front wall of the reserve oil tank 3. A link rod (not clearly shown) for steering the steering skis 62*a*, 62*b* is mounted to the lower end of the downward extended portion 63*a*2.

The dry sump reserve oil tank 3 has a structure generally described above, with the above-described layout structure relative to the internal combustion engine E, and has the above-described structure in relation to the steering shaft 63*a* in the steering system 63 in the snowmobile 60.

Figure 12:
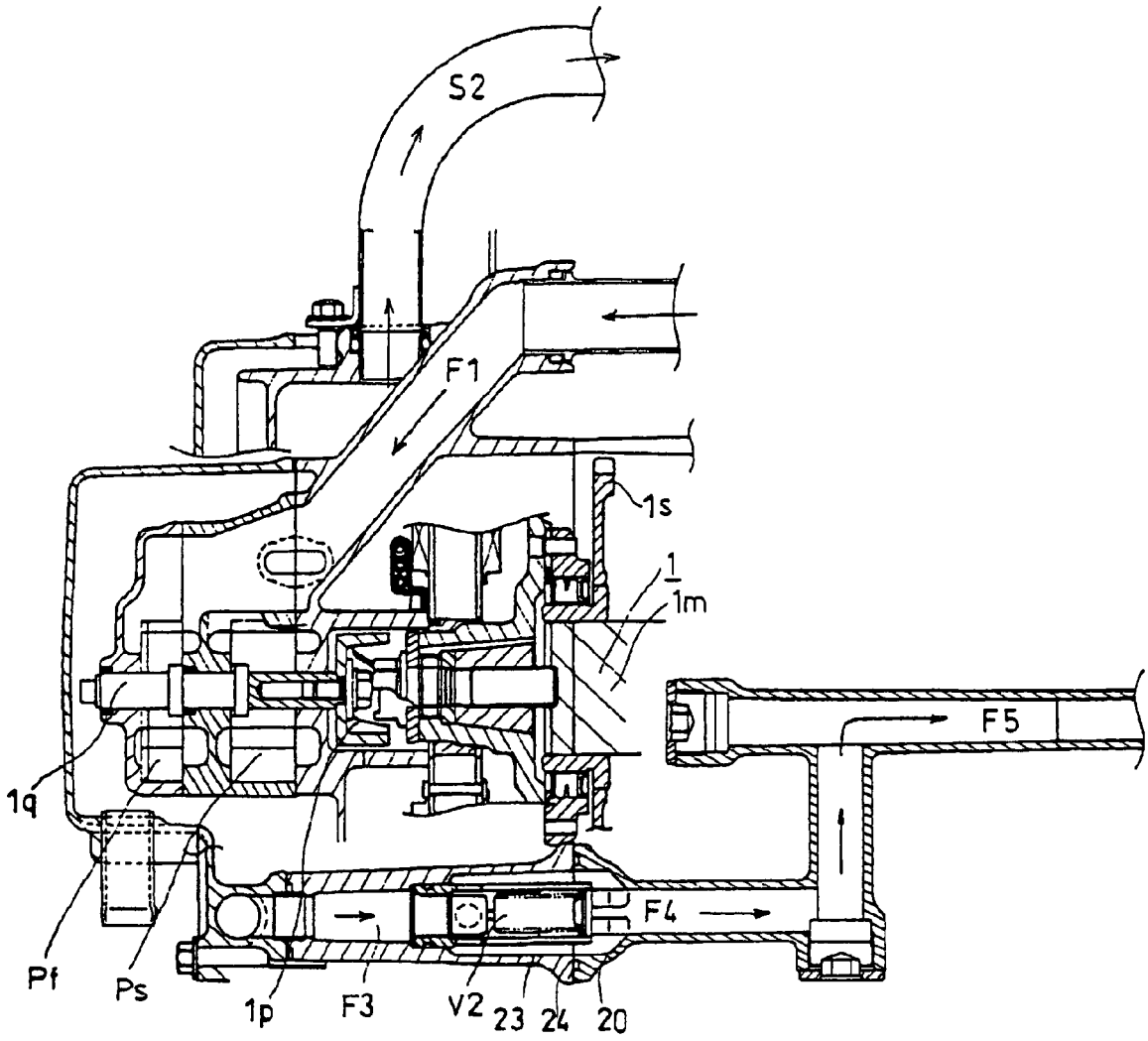
FIG. 12 shows an essential structural part of a lubricating oil supply passage according to the present invention.

In addition, as understood by referring to FIGS. 4, 7 and 12, an oil cooler 11 and an oil filter 12 are disposed at wall portions corresponding to portions of the cylinder block 30 and the cylinder head 40 in a side portion (the left side surface in FIG. 4) that are parallel to the vehicle traveling direction of the engine E and at a location roughly on the upper side of the oil pumps Pf, Ps and the generator 2 at the left end 1*m* of the crankshaft 1. The oil cooler 11 and the oil filter 12 are integral with each other. A lower structural portion of a unit 10 having an integral structure in the mount condition is mounted to an upper portion of a crankcase cover 23, whereby the above-described layout is attained.

The lower structural portion in the mount condition of the integrally structured unit 10, i.e., the lower structural portion that serves for mounting onto the upper portion of the crankcase cover 23 is configured as the oil cooler 11. The oil cooler 11 comprises a cylindrical heat exchange portion not clearly shown in FIG. 4, and is provided with a cooling water introduction pipe 11*a* and a cooling water discharge pipe 11*b* for this purpose. See FIG. 14. In addition, an upper structural portion of the unit 10 is configured as the oil filter 12.

As has been described above, the internal combustion engine E in this embodiment has the generally above-mentioned structure, and the layout of the reserve oil tank and accessories around the engine also has the above-mentioned structure.

Figure 13:
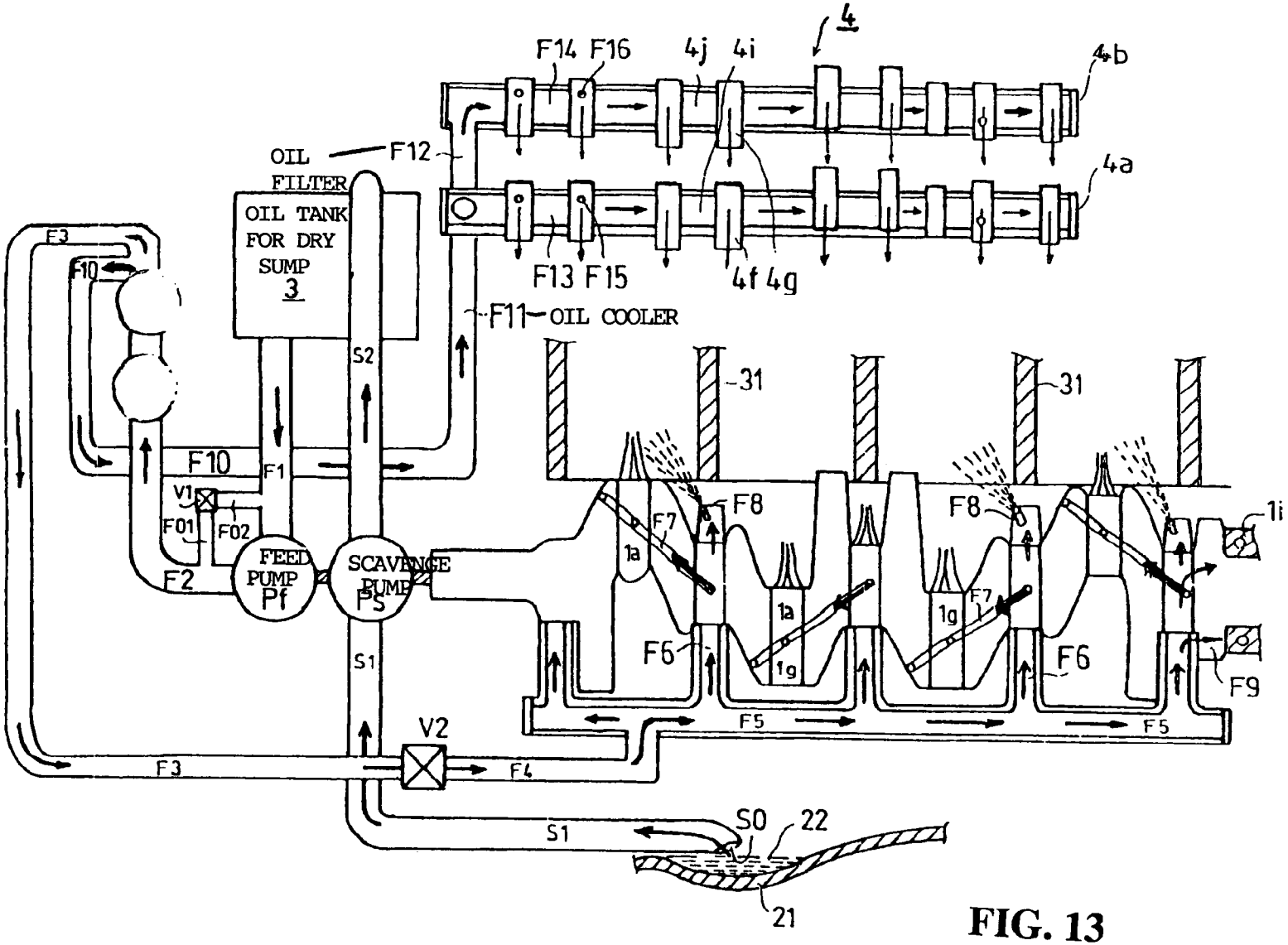
FIG. 13 is a schematic illustration of the lubricating oil supply system in the internal combustion engine according to the present invention.

Here, a description will be added as to the lubricating oil supplying structure adopting the so-called dry sump system in the internal combustion engine E. In addition, a schematic diagram of the lubricating oil supply system in this embodiment is shown in FIG. 13.

As has been described above and as understood by referring to FIGS. 4 and 12, at the left end 1*m* of the crankshaft 1, there are provided side by side the two oil pumps Pf, Ps, namely, the feed pump Pf and the scavenge pump Ps, which are provided on the pump shaft 1*q* that are kept coaxial with the crankshaft 1 and rotated in conjunction with the crankshaft 1.

As shown in FIG. 7, the suction port PfA of the feed pump Pf is communicated with the lower opening 3*c* of the dry sump oil tank 3 through a lubricating oil suction passage F1, while the discharge port PfB of the feed pump Pf is communicated with the unit 10 comprising the oil cooler 11 and the oil filter 12 integral with each other through a lubricating oil supply passage F2, and the lubricating oil supply passage F2 provides communication between a lower portion of the unit 10 and the discharge port PfB of the feed pump Pf. Therefore, driving the feed pump Pf supplies the lubricating oil present in the dry sump oil tank 3 to the unit 10.

In addition, the lubricating oil supply passage F2 is provided with a branch oil passage F01. See FIG. 13. Further, a relief valve V1 (see FIGS. 7 and 13) is disposed in the branch oil passage F01. The valve V1 acts to regulate the lubricating oil supply pressure in the lubricating oil supply passage F2, and the lubricating oil flowing out from the relief valve V1 is again returned into the lubricating oil suction passage F1 through a branch oil passage F02. See FIG. 13.

Figure 8:
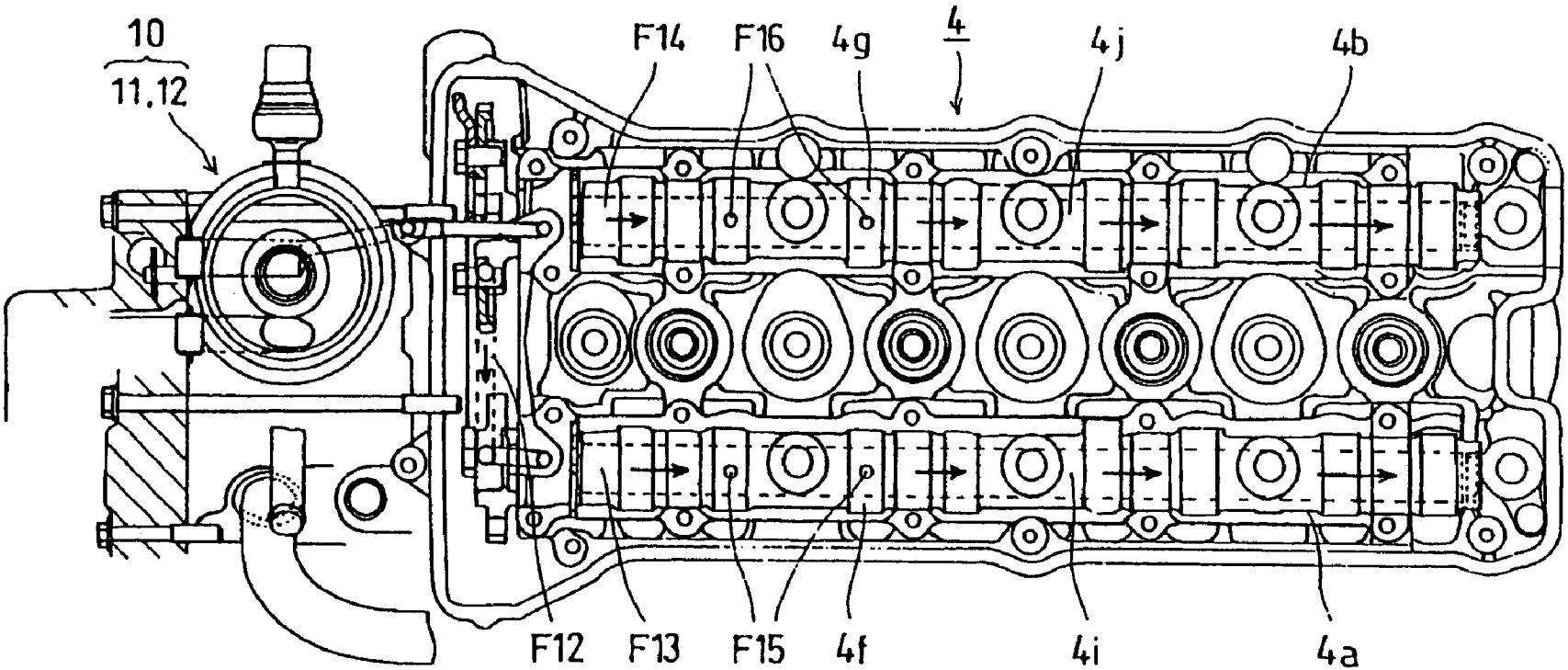
FIG. 8 is a top plan view of the internal combustion engine according to the present invention.

The lubricating oil supplied to the unit 10, that is filtered by the oil filter 12 in the unit 10 and cooled by the oil cooler 11 is then supplied from the supply passage in the vicinity of a lubricating oil outlet of the unit 10 to an oil gallery F5 through branch supply passages, i.e., lubricating oil supply passages F3, F4 (see FIG. 7) and to the valve operating system 4, i.e., camshafts 4*a*, 4*b* in the valve operating system 4 through lubricating oil supply passages F10, F11 (see FIG. 4), as understood by referring to FIGS. 4, 7, 8.

The lubricating oil supply passages F3, F4, which are branch supply passages to the oil gallery F5 that communicate with the lubricating oil outlet of the unit 10, are equipped therein with check valves V2 (see FIG. 12), and the layout of the check valves V2 is conducted by utilizing the mating surface 24 between the crankcase 20 and the case cover 23.

As shown in FIG. 4, the oil gallery F5 extends in parallel to the crankshaft 1 on the lower side of the crankshaft 1, and the extension length thereof is such so as to range over roughly the entire length of the crankshaft 1. A plurality of lubricating oil supply passages F6, F7 are provided for supplying the lubricating oil from the oil gallery F5 to the crank pin portions 1*a* to which the journal portions 1*g* and the connecting rods 1*b* of the crankshaft 1. The plurality of lubricating oil supply passages F6, F7 are connected and are branchedly provided in the gallery F5.

In addition, injection ports F8 are provided for jetting the lubricating oil to inside wall portions of the cylinder bores 31. Further, a lubricating oil supply passage F9 for supplying the lubricating oil to the ball bearing 1*i* near the right end of the crankshaft 1 are branched from the oil gallery F5.

As shown in FIG. 4, lubricating oil supply passages F10, F11, that communicate with the camshafts 4*a*, 4*b* of the valve operating system 4, are formed as the supply passage F10 that is in communication with the lubricating oil outlet of the unit 10 and extends horizontally through a joint portion 24 of the crankcase 20 and the crankcase cover 23, and the supply passage F11 is bent roughly rectangularly from the supply passage F10 and extends upwardly along opening portions 30A, 40A for the cam chain 4*e* of the cylinder block 30 and the cylinder head 4 on the upper side of the crankcase 20. The supply passages F10, F11 are in communication with lubricating oil supply passages F13, F14 in the camshafts 4*a*, 4*b* through a branch supply passage F12, and a plurality of open holes F15, F16 that are opened in cam surfaces are provided in the lubricating oil supply passages F13, F14 in the camshafts 4*a*, 4*b*. See FIG. 8.

The scavenge pump Ps, that is arranged side by side relative to the feed pump Pf, has a pump suction port PsA (see FIG. 4) connected to an oil passage S1 for sucking the collected oil (described later) in the bottom portion 21 of the crankcase 20. In FIG. 4, the collected oil suction passage S1 extends from the pump suction port PsA to an oil collection portion 22 located at roughly a central portion of the bottom portion 21 of the crankcase 20. The extension end thereof fronting on the oil collection portion 22 is provided with an opening S0 for sucking the collected oil present in the oil collection portion 22.

In addition, the collected oil suction passage S1 extends from the oil collection portion 22 roughly horizontally along the bottom portion 21 of the crankcase 20 and along the crankshaft 1 and extends on the lower side of the oil gallery F5 and in parallel to the crankshaft 1 and the oil gallery F5, to be in communication with the suction port PsA of the scavenge pump Ps.

As shown in FIG. 7, the discharge port PsB of the scavenge pump Ps is in communication with the upper opening 3*d* of the dry sump reserve oil tank 3 through the collected oil return passage S2, and the passage S2 extends roughly skewly upwardly from the pump discharge port PsB towards an upper portion of the oil tank 3. Therefore, by the structure of both the oil passages S1, S2 that are in communication with the scavenge pump Ps, the collected oil in the crankcase bottom portion 21 is returned to the dry sump reserve oil tank 3 by driving the scavenge pump Ps.

The supply of the lubricating oil in the internal combustion engine E having the lubricating oil supplying structure as described above will be additionally described referring to FIGS. 4, 7, and 8. It is to be noted that the above described supply of the lubricating oil is explained in the schematic diagram of the lubrication oil supply system shown in FIG. 13.

Attendant on the rotation of the crankshaft 1 by starting the internal combustion engine E, the two oil pumps Pf, Ps, namely, the feed pump Pf and the scavenge pump Ps are driven. As shown in FIGS. 7 and 13, with the feed pump Pf driven, the lubricating oil in the dry sump reserve oil tank 3 is sucked through the lubricating oil suction passage F1 and the pump suction port PfA into the pump Pf. Thus, the pump pressure for the lubricating oil is raised in the pump Pf, and the lubricating oil is fed under pressure from the discharge port PfB of the pump Pf.

The lubricating oil fed under pressure from the discharge port PfB of the pump Pf flows through the lubricating oil supply passage F2, to be supplied into the unit 10 comprising the oil cooler 11 and the oil filter 12 that are integral with respect to each other.

The supply pressure in the lubricating oil supply passage F2 is regulated by the relief valve V1 provided in the branch oil passage F01 (see FIG. 13), and the lubricating oil flowing out of the valve V1 under the pressure regulating action of the valve V1 is returned through the oil passage F02 (see FIG. 13) to the lubricating oil suction passage F1.

The lubricating oil flowing into the unit 10 is circulated in the unit 10, while it is filtered by the oil filter 12 and is cooled by the heat exchange portion of the oil cooler 11. The lubricating oil filtered and cooled in the unit 10 flows through the branch lubricating oil supply passage F3, F4 and F10, F11 (see FIG. 4), to be supplied, respectively, to the oil gallery F5 and the camshafts 4*a*, 4*b* and the like in the valve operating system 4.

The lubricating oil fed under pressure into the branch lubricating oil supply passage F3 is in communication with the oil gallery F5 that flows through the supply passage F3, pushes open the above-mentioned check valve V2 (see FIG. 12), and flows through the lubricating oil supply passage F4, to be supplied into the gallery F5. The lubricating oil supplied into the oil gallery F5 flows through the oil gallery F5 extending along the crankshaft 1 on the lower side of the crankshaft 1.

The lubricating oil having flowed through the gallery F5 passes through the branch lubricating oil supply passages F6, F7, and is supplied to the journal portions 1*g* and the crank pin portions 1*a*, to which the connecting rods 1*b* are connected, of the crankshaft 1 so as to lubricate these components. In addition, the lubricating oil is supplied to the cylinder bore inside wall 31 via the lubricating oil injection ports F8 and is supplied through the branch lubricating oil supply passage F9 to the ball bearing 1*i* near the right end of the crankshaft 1 so as to lubricate these components. See FIG. 4.

On the other hand, the lubricating oil fed under pressure to the branch lubricating oil supply passages F10, F11 is in communication with the camshafts 4*a*, 4*b* in the valve operating system 4 and flows first in the lubricating oil supply passage F10 extending horizontally while passing through the mating surface 24 of the crankcase 20 and the case cover 23, and flows into the lubricating oil supply passage F11 which is bent roughly perpendicularly and extends upwardly through the wall portions of the opening portions 30A, 40A for the cam chain 4*e* of the cylinder block 30 and the cylinder head 40 along the wall portions and the water jacket 32 of the cylinder block 30. See FIG. 4.

The lubricating oil having flowed through the lubricating oil supply passage F11 is branched while passing through the two lubricating oil supply passages F12 that are branched at an upper portion of the supply passage F11. The branched streams flow through the lubricating oil supply passages F13, F14 that are hollow hole portions 4*i*, 4*j* in the two camshafts 4*a*, 4*b*, i.e., the respective camshafts 4*a*, 4*b* of the camshaft 4*a* on the intake side and the camshaft 4*b* on the exhaust side and flow from the lubricating oil supply passages F13, F14 through open holes F15, F16 opened in a plurality of cam surfaces to flow out of the cam surfaces, and serve to lubricate and cool the cam surfaces of the cams 4*f*, 4*g*, the tappets 4*h* and the like. See FIGS. 4 and 8. The return oil having been served for lubrication flows to the oil collection portion 22 in the bottom portion 21 of the crankcase 20 through the return oil passage and the like penetrating through the cylinder block 30 not clearly shown in the figures.

Though not clearly shown or described, the lubricating oil is appropriately supplied to drive shaft portions of accessories and the like through other branch lubricating oil supply passages.

The lubricating oil served for lubrication of the above-mentioned portions of the engine drops in the engine E, or is passed through a lubricating return passage not clearly shown in the figures, to flow to the oil collection portion 22 in the bottom portion 21 of the crankcase 20. See FIG. 4.

The lubricating oil that serves for lubrication of the above-mentioned portions of the internal combustion engine E is dropped into the oil collection portion 22 in the bottom portion 21 of the crankcase 20 or passed through the return oil passage not clearly shown to flow into the oil collection portion 22 and is sucked through the collected oil suction passage S1 and the pump suction port PsA by the scavenge pump Ps driven together with the feed pump Pf. Thus, the pump pressure for the collected lubricating oil is raised in the pump Ps and the collected oil is passed through the collected oil return passage S2 to be returned and recovered into the dry sump reserve oil tank 3 (see FIGS. 4 and 7), and is again fed through the above-mentioned lubricating oil supply routes, to serve to lubricate the above-mentioned portions of the engine E.

Now, a description will be added as to the cooling structure in the internal combustion engine E in this embodiment.

Figure 15:
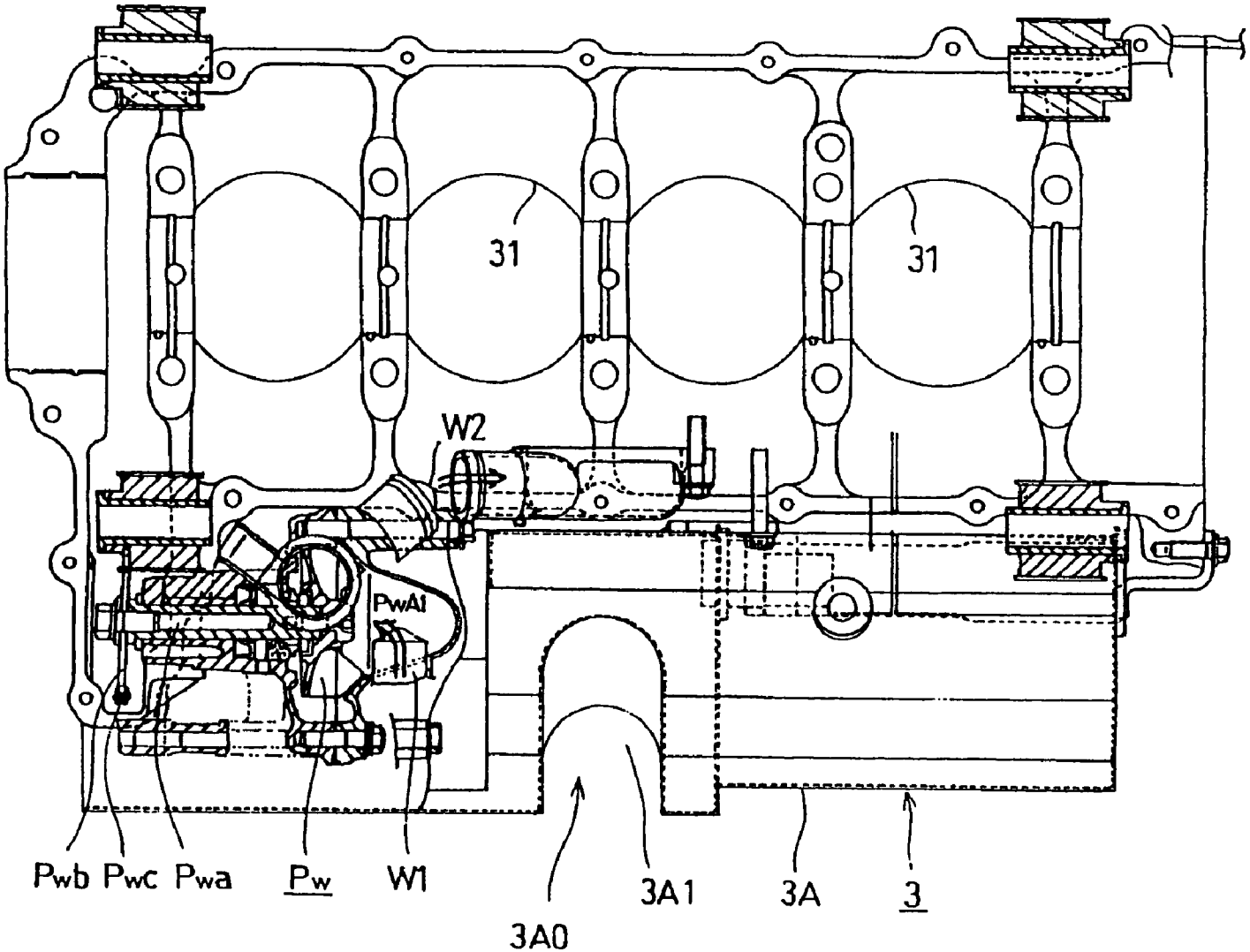
FIG. 15 shows a part of an essential cooling water supply structure in the internal combustion engine according to the present invention.

As shown in FIG. 6, the cooling water pump Pw disposed in the cutout space portion E1*a* of the dry sump reserve oil tank 3 at the internal combustion engine front portion E1 is driven to rotate synchronously with the rotation of the crankshaft 1 through a chain Pwc wrapped around the sprocket 1*k* (see FIGS. 3 and 4) provided near the right end portion 1*h* in FIG. 6 of the crankshaft as mentioned above and the sprocket Pwb is attached to a cooling water pump shaft Pwa. See FIGS. 3 and 15.

Figure 14:
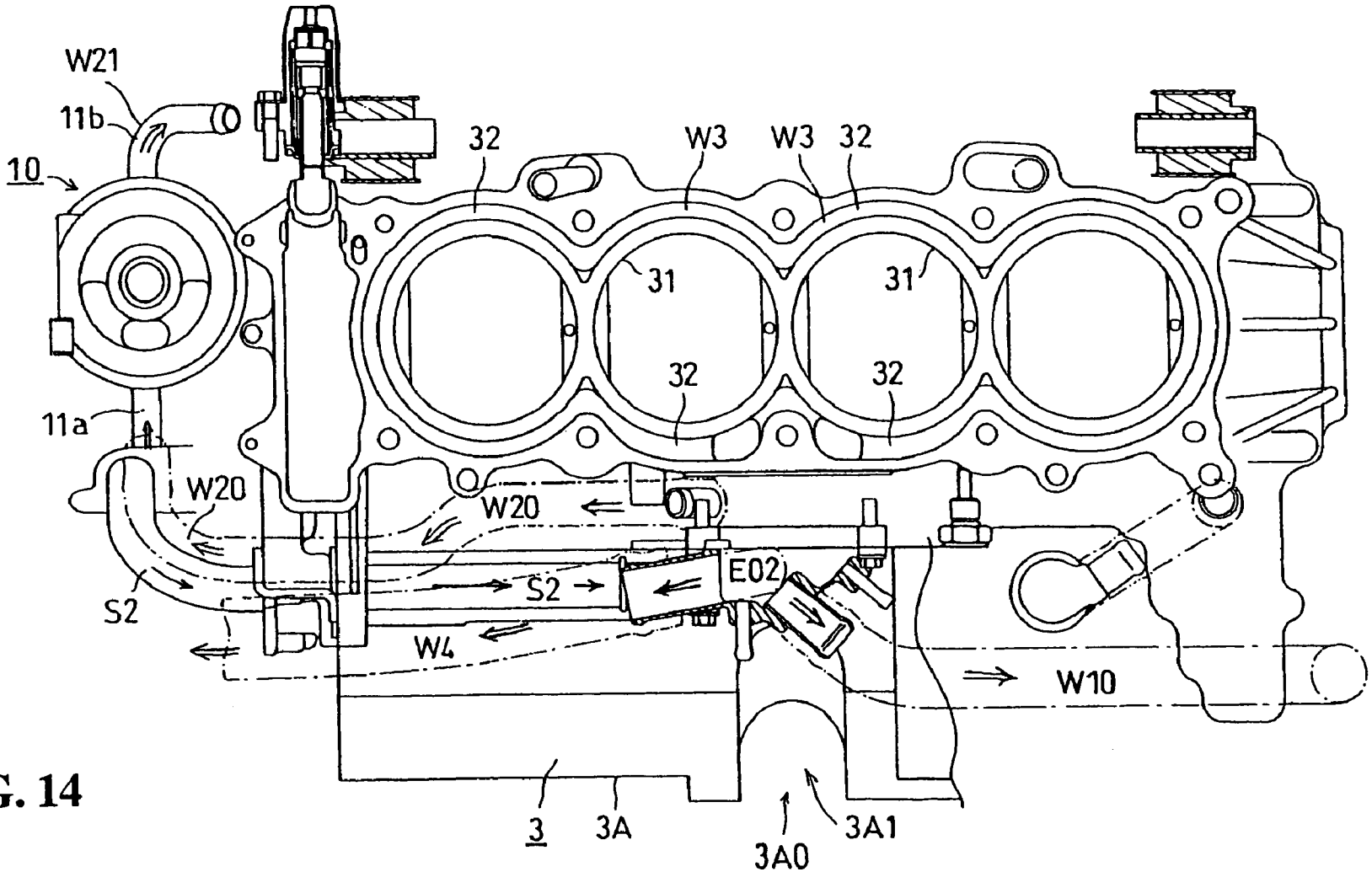
FIG. 14 shows an essential structural part of a cooling water supply passage in the internal combustion engine according to the present invention.

As understood by referring to FIGS. 6 and 14, a cooling water return passage W1 is provided for communication between a cooling water suction port PwA1 of the cooling water pump Pw and a cooling water outlet of a radiator 68 (see FIG. 1) shown in FIGS. 6 and 14 which is disposed on the lower side of the seat 64 in the snowmobile 60. In addition, a cooling water supply passage W2 is provided for communication between the cooling water discharge port PwB of the cooling water pump Pw and a cooling water introduction port E01 for introducing the cooling water via the center of the engine front portion E1 to the engine E. Further, a cooling water supply passage W3 is provided which includes a water jacket 32 and the like and through which the cooling water introduced via the cooling water introduction port E01 for introducing the cooling water via the center of the engine front portion E1 to the engine E is introduced to the periphery of the cylinders 31 of the engine E.

In addition, a cooling water passage W4 is provided which is for communication between the outlet of the cooling water supply passage W3, namely, the cooling water discharge port E02 for discharge from the inside of the engine E and the cooling water inlet of the radiator 68 and which is regulated by a thermostat and a reserve tank (not shown). In addition, a bypass cooling water passage W10 is provided (see FIGS. 6 and 14) for the time of cooling (the time of warming operation) through which the cooling water having low temperature passes that is branched from the thermostat, and the passage W10 is in communication with the suction port PwA2 (see FIG. 6) of the cooling water pump Pw.

In addition, while the cooling water introduction port E01 for introduction to the engine E is located at a roughly central portion in the vertical direction of the cylinder block 30, the cooling water outlet E02 for discharge from the engine E is located at an upper portion in the vertical direction of the cylinder block 30. Therefore, the cooling water introduction port E01 and the cooling water discharge port E02 are disposed in an upper-lower relationship with each other in the cylinder block 30. See FIG. 6.

Further, a cooling water supply passage W20, connected to a cooling water introduction pipe 11*a* of the oil cooler 11, is provided at a position in the vicinity of a connection portion between the cooling water supply passage W2 and the cooling water introduction passage E01 (see FIGS. 6 and 14). In addition, a cooling water passage W21 that is connected to a cooling water discharge pipe 11*b* of the oil cooler 11 is also provided. Though not shown in the figures, the cooling water passage W21 is in communication with the cooling water passage W4 for communication between the cooling water discharge port E02 and the cooling water inlet of the radiator 68.

Therefore, when the cooling water pump Pw is driven to rotate in conjunction with the rotation of the crankshaft 1 caused by starting the internal combustion engine E and cooling water cooled in the radiator 68 is sucked in via the suction port PwA1 of the pump Pw, the cooling water that is sucked into the pump Pw is raised in its pump pressure in the pump Pw, is discharged via the discharge port PwB of the pump Pw, and is passed through the cooling water supply passage W2 and through the cooling water introduction port E01 provided at the center of the engine front portion E1 into the engine E (see FIG. 6), to flow into the cooling water supply passage W3 which includes the water jackets 32 or the like in the engine E. See FIG. 14.

The cooling water flowing into the cooling water supply passage W3 in the engine E is introduced into the water jackets 32 around the cylinder bores 31 forming essential parts of the passage W3, flows through the jackets 32, and flows through cooling water supply passages in the cylinder head 40 which are not shown, to absorb heat. The cooling water thus warmed is discharged to the exterior of the engine E via the outlet of the cooling water passage W3 in the engine E, namely, via the cooling water discharge port E02 for discharge from the inside of the engine E, and flows through the cooling water passage W4 which is a passage in communication with the discharge port E02 that is provided for connection to the radiator 68 (see FIG. 14), and is introduced from an upper portion of the radiator 68 into the inside of the radiator 68 through an inlet.

The warmed cooling water introduced into the inside of the radiator 68 is circulated in the radiator 68, to be deprived of heat during the circulation process, whereby the cooling water is cooled. Then, the cooling water thus cooled is again sucked into the suction port PwA1 of the cooling water pump Pw via the cooling water return passage W1 (see FIG. 6), and is passed through the above-mentioned cooling water supply routes to be circulated for being served to cooling of the portions of the engine E.

The invention in this embodiment has the above-described structure, and displays the following functions or effects peculiar to this embodiment.

In this embodiment, the reserve oil tank 3 is provided with the recessed groove 3A1 which is a recessed portion formed in the wall 3A on one side in the longitudinal direction thereof, namely, the tank front wall, and the steering shaft 63*a* passes through the inside of the recessed groove 3A1. Therefore, it is possible to lay out the steering shaft 63*a* compactly, to achieve an effective utilization of space, and to enlarge the degree of freedom in selecting the layout of various component parts in a limited space in the snowmobile 60.

The steering shaft 63*a* passing on the front side of the internal combustion engine E is substantially contained in the recessed groove 3A1 while passing through the inside of the recessed groove 3A1. Therefore, it is possible to reduce the length in the front-rear direction of the vehicle body of the snowmobile 60. Accordingly, it is possible to reduce the size of the vehicle body of the snowmobile 60.

In addition, in a vehicle body side view, the steering shaft 63*a* passing through the inside of the recessed groove 3A1 formed in the wall 3A on one side in the longitudinal direction of the reserve oil tank 3, namely, the tank front wall, is entirely covered by the tank front wall being the one-side wall 3A of the reserve oil tank 3 to be directly invisible, or is partly or nearly mostly covered by the front wall of the tank 3 to be partly or mostly invisible. Therefore, an enhancement in the appearance of the vehicle in a side view is achieved.

The reserve oil tank 3 is provided with cutouts 3C, 3D on the right lower side and the left upper side in a front view, and the cooling water pump Pw and the starter motor 5 are disposed in the respective space portions E1*a*, E1*b* defined by the cutouts 3C, 3D in a layout of the tank 3 at the engine front portion W1. Therefore, it is possible to effectively utilize the space for laying out accessories in the engine front portion E1, and to achieve a reduction in the size of the vehicle body of the snowmobile 60. In addition, since the surroundings of the engine E are made compact in form, it is easy to mount the engine E onto the vehicle body of the snowmobile 60, and the cost of mounting the engine E onto the vehicle body can be reduced accordingly.

The reserve oil tank 3 is disposed at the front portion E1 of the internal combustion engine E having its crankshaft disposed orthogonal to the front-rear direction of the vehicle body so as to cross the engine front portion E1, so that the tank width B in the front-rear direction of the tank 3 is restrained from being substantially enlarged. Moreover, as described above, the cooling water pump Pw and the starter motor 5 are contained in the space portions E1*a*, E1*b* defined by the cutouts 3C, 3D on the right lower side and the left upper side of the reserve oil tank 3, and the steering shaft 63*a* is passed through the recessed wall 3A1 in the front wall being the wall 3A on one side in the longitudinal direction of the tank 3, so that a reduction in the length of the vehicle body of the snowmobile 60 is effectively achieved.

In addition, since the reserve oil tank 3 and various accessories and the like are concentratedly laid out at the engine front portion E1, the layout of the accessories and the like at side portions of the engine E and at a rear portion of the engine E can be largely reduced. Thus, the length and crosswise width of the snowmobile 60 can be reduced, and the snowmobile 60 can be reduced in size. Moreover, the reduction or removal of the layout of accessories at the rear portion of the engine E makes it possible for the rider seated on the rear portion side of the engine E to approach the engine E, so that effective utilization of space in the snowmobile 60 is achieved. Thus, the vehicle body length of the snowmobile 60 can be reduced.

The structure of the reserve oil tank in the internal combustion engine and the structure for laying out the tank according to the present invention can be adopted in various vehicle internal combustion engines within an applicable range.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A snowmobile comprising:

a dry sump type internal combustion engine mounted on a front side of a vehicle body;

a rider's seat provided on a rear side of said internal combustion engine;

a crankshaft operatively connected within said internal combustion engine; and a transmission mechanism through which the rotation of said crankshaft is transmitted to an endless track belt for driving said endless track belt to rotate, thereby driving said snowmobile to travel;

wherein said internal combustion engine provided on a front side of said rider's seat is mounted with said crankshaft disposed crosswise relative to the traveling direction, a reserve oil tank is disposed across a central portion of said vehicle body along said internal combustion engine on the front side of said internal combustion engine, and a steering shaft is provided along the vertical direction at roughly a central portion of said vehicle body on the front side of said internal combustion engine, said reserve oil tank is provided on a front side with a recessed portion through which to pass said steering shaft, and said reserve oil tank and said steering shaft are disposed to overlap each other at least partly in a vehicle body side view, wherein the recessed portion is a recessed groove formed in a wall surface of the reserve oil tank, said recessed groove being an arcuate section for receiving the steering shaft with an allowance and without hindering a turning of the steering shaft, and wherein said steering shaft includes a second extended portion, said second extended portion being substantially entirely received within said recessed groove in a vehicle side view.

2. The snowmobile as set forth in claim 1, wherein said recessed portion is vertically continuous in the range from an upper end portion to a lower end portion of said reserve oil tank, and is shaped along the inclination of said steering shaft.

3. The snowmobile as set forth in claim 1, and further including an upper opening formed in said reserve oil tank for receiving oil and a lower opening formed in said reserve oil tank for supplying oil discharged from the reserve oil tank.

4. A snowmobile comprising:

a dry sump type internal combustion engine mounted on a front side of a vehicle body;

a rider's seat provided on a rear side of said internal combustion engine;

a crankshaft operatively connected within said internal combustion engine; and a transmission mechanism through which the rotation of said crankshaft is transmitted to an endless track belt for driving said endless track belt to rotate, thereby driving said snowmobile to travel;

wherein said internal combustion engine provided on a front side of said rider's seat is mounted with said crankshaft disposed crosswise relative to the traveling direction, a reserve oil tank is disposed across a central portion of said vehicle body along said internal combustion engine on the front side of said internal combustion engine, and a steering shaft is provided along the vertical direction at roughly a central portion of said vehicle body on the front side of said internal combustion engine, said reserve oil tank is provided on a front side with a recessed portion through which to pass said steering shaft, and said reserve oil tank and said steering shaft are disposed to overlap each other at least partly in a vehicle body side view, and wherein said reserve oil tank includes at least one cut out portion for receiving a water pump.

5. A snowmobile comprising:

a dry sump type internal combustion engine mounted on a front side of a vehicle body;

a rider's seat provided on a rear side of said internal combustion engine;

a crankshaft operatively connected within said internal combustion engine; and a transmission mechanism through which the rotation of said crankshaft is transmitted to an endless track belt for driving said endless track belt to rotate, thereby driving said snowmobile to travel;

wherein said internal combustion engine provided on a front side of said rider's seat is mounted with said crankshaft disposed crosswise relative to the traveling direction, a reserve oil tank is disposed across a central portion of said vehicle body along said internal combustion engine on the front side of said internal combustion engine, and a steering shaft is provided along the vertical direction at roughly a central portion of said vehicle body on the front side of said internal combustion engine, said reserve oil tank is provided on a front side with a recessed portion through which to pass said steering shaft, and said reserve oil tank and said steering shaft are disposed to overlap each other at least partly in a vehicle body side view, and wherein said reserve oil tank includes at least one cut out portion for receiving a starter motor.

6. A snowmobile comprising:

a dry sump type internal combustion engine mounted on the front side of a vehicle body;

a rider's seat provided on the rear side of said internal combustion engine;

a crankshaft operatively connected mounted within said internal combustion engine;

a transmission mechanism through which the rotation of said crankshaft is transmitted to an endless track belt for driving said endless track belt to rotate, thereby driving said snowmobile to travel;

wherein said internal combustion engine is provided on the front side of said rider's seat and is mounted with said crankshaft disposed crosswise relative to the traveling direction, a reserve oil tank is disposed across a central portion of said vehicle body along said internal combustion engine on the front side of said internal combustion engine, said oil tank is provided with a cutout portion, an accessory is provided at said cutout portion, and said reserve oil tank and said accessory are disposed to overlap each other at least partly in a vehicle body side view, wherein a recessed groove is formed in a wall surface of the reserve oil tank, said recessed groove being an arcuate section for receiving a steering shaft with an allowance and without hindering a turning of the steering shaft, and wherein said steering shaft includes a second extended portion, said second extended portion being substantially entirely received within said recessed groove in a vehicle side view.

7. The snowmobile as set forth in claim 6, and further including an upper opening formed in said reserve oil tank for receiving oil and a lower opening formed in said reserve oil tank for supplying oil discharged from the reserve oil tank.

8. A snowmobile comprising:

a dry sump type internal combustion engine mounted on the front side of a vehicle body;

a rider's seat provided on the rear side of said internal combustion engine;

a crankshaft operatively connected mounted within said internal combustion engine;

a transmission mechanism through which the rotation of said crankshaft is transmitted to an endless track belt for driving said endless track belt to rotate, thereby driving said snowmobile to travel;

wherein said internal combustion engine is provided on the front side of said rider's seat and is mounted with said crankshaft disposed crosswise relative to the traveling direction, a reserve oil tank is disposed across a central portion of said vehicle body along said internal combustion engine on the front side of said internal combustion engine, said oil tank is provided with a cutout portion, an accessory is provided at said cutout portion, and said reserve oil tank and said accessory are disposed to overlap each other at least partly in a vehicle body side view, and wherein said accessory is a water pump or a starter motor.

9. A snowmobile comprising:

a dry sump type internal combustion engine mounted on the front side of a vehicle body;

a rider's seat provided on the rear side of said internal combustion engine;

a crankshaft operatively connected mounted within said internal combustion engine;

a transmission mechanism through which the rotation of said crankshaft is transmitted to an endless track belt for driving said endless track belt to rotate, thereby driving said snowmobile to travel;

wherein said internal combustion engine is provided on the front side of said rider's seat and is mounted with said crankshaft disposed crosswise relative to the traveling direction, a reserve oil tank is disposed across a central portion of said vehicle body along said internal combustion engine on the front side of said internal combustion engine, said oil tank is provided with a cutout portion, an accessory is provided at said cutout portion, and said reserve oil tank and said accessory are disposed to overlap each other at least partly in a vehicle body side view, and wherein a muffler is provided on the front side of said reserve oil tank, and an exhaust pipe is connected to said muffler while bypassing an upper portion of said reserve oil tank.

10. A reserve oil tank for use with a snowmobile comprising: a dry sump type internal combustion engine mounted on a front side of a vehicle body; a reserve oil tank disposed across a central portion of said vehicle body along said internal combustion engine on a front side of said internal combustion engine; a steering shaft provided along a vertical direction at roughly a central portion of said vehicle body on the front side of said internal combustion engine, said reserve oil tank is provided on a front side with a recessed portion through which said steering shaft passes, and said reserve oil tank and said steering shaft are disposed to overlap each other at least partly in a vehicle body side view, wherein the recessed portion is a recessed groove formed in a wall surface of the reserve oil tank, said recessed groove being an arcuate section for receiving the steering shaft with an allowance and without hindering a turning of the steering shaft, and wherein said steering shaft includes a second extended portion, said second extended portion being substantially entirely received within said recessed groove in a vehicle side view.

11. The reserve oil tank for use with a snowmobile as set forth in claim 10, wherein said recessed portion is vertically continuous in the range from an upper end portion to a lower end portion of said reserve oil tank, and is shaped along the inclination of said steering shaft.

12. The reserve oil tank for use with a snowmobile as set forth in claim 10, and further including an upper opening formed in said reserve oil tank for receiving oil and a lower opening formed in said reserve oil tank for supplying oil discharged from the reserve oil tank.

13. A reserve oil tank for use with a snowmobile comprising:

a dry sump type internal combustion engine mounted on a front side of a vehicle body;

a reserve oil tank disposed across a central portion of said vehicle body along said internal combustion engine on a front side of said internal combustion engine;

a steering shaft provided along a vertical direction at roughly a central portion of said vehicle body on the front side of said internal combustion engine, said reserve oil tank is provided on a front side with a recessed portion through which said steering shaft passes, and said reserve oil tank and said steering shaft are disposed to overlap each other at least partly in a vehicle body side view, wherein said reserve oil tank includes at least one cut out portion for receiving a water pump.

14. A reserve oil tank for use with a snowmobile comprising:

a dry sump type internal combustion engine mounted on a front side of a vehicle body;

a reserve oil tank disposed across a central portion of said vehicle body along said internal combustion engine on a front side of said internal combustion engine;

a steering shaft provided along a vertical direction at roughly a central portion of said vehicle body on the front side of said internal combustion engine, said reserve oil tank is provided on a front side with a recessed portion through which said steering shaft passes, and said reserve oil tank and said steering shaft are disposed to overlap each other at least partly in a vehicle body side view, wherein said reserve oil tank includes at least one cut out portion for receiving a starter motor.

15. A snowmobile comprising:

a dry sump type internal combustion engine mounted on a front side of a vehicle body;

a water pump configured to provide cooling water to the dry sump type internal combustion engine;

a starter configured to start the dry sump type internal combustion engine;

a reserve oil tank disposed across a central portion of said vehicle body along said internal combustion engine on a front side of said internal combustion engine;

a rider's seat provided on the rear side of said internal combustion engine;

a crankshaft operatively connected mounted within said internal combustion engine;

a transmission mechanism through which the rotation of said crankshaft is transmitted to an endless track belt for driving said endless track belt to rotate, thereby driving said snowmobile to travel; and a steering shaft provided along a vertical direction at roughly a central portion of said vehicle body on the front side of said internal combustion engine, wherein the reserve oil tank is provided on a front side of the internal combustion engine and includes a recessed portion through which said steering shaft passes, a first cut out portion for accommodating the water pump and a second cutout portion for accommodating the starter.

16. The snowmobile as set forth in claim 15, wherein the reserve oil tank and the steering shaft are disposed to overlap each other at least partly in a vehicle body side view.

17. The snowmobile as set forth in claim 15, wherein a portion of the steering shaft that passes through the recessed portion of the reserve oil tank is completely received in the recessed groove in a vehicle side view.

* * * * *